US012263385B2

(12) United States Patent
Spackman

(10) Patent No.: US 12,263,385 B2
(45) Date of Patent: Apr. 1, 2025

(54) GOLF CLUB HEAD WITH INSERT

(71) Applicant: KARSTEN MANUFACTURING CORPORATION, Phoenix, AZ (US)

(72) Inventor: Clayson C. Spackman, Scottsdale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 18/263,694

(22) PCT Filed: Feb. 2, 2022

(86) PCT No.: PCT/US2022/014969
§ 371 (c)(1),
(2) Date: Jul. 31, 2023

(87) PCT Pub. No.: WO2022/169894
PCT Pub. Date: Aug. 11, 2022

(65) Prior Publication Data

US 2024/0091608 A1 Mar. 21, 2024

Related U.S. Application Data

(60) Provisional application No. 63/203,754, filed on Jul. 29, 2021, provisional application No. 63/144,871, filed on Feb. 2, 2021.

(51) Int. Cl.
*A63B 53/04* (2015.01)

(52) U.S. Cl.
CPC ..... *A63B 53/0475* (2013.01); *A63B 53/0412* (2020.08); *A63B 53/045* (2020.08); *A63B 2053/0491* (2013.01)

(58) Field of Classification Search
CPC ..... A63B 53/047; A63B 53/0475
See application file for complete search history.

(56) References Cited

U.S. PATENT DOCUMENTS

| | | | | |
|---|---|---|---|---|
| 5,800,282 | A * | 9/1998 | Hutin | A63B 60/02 473/331 |
| 6,440,009 | B1 | 8/2002 | Guibaud | |
| 6,929,563 | B2 * | 8/2005 | Nishitani | A63B 53/047 473/335 |
| 2012/0231897 | A1 | 9/2012 | Hettinger | |
| 2017/0239533 | A1 * | 8/2017 | Cole | A63B 53/0475 |

(Continued)

OTHER PUBLICATIONS

International Search Report and Written Opinion from Int'l App. No. PCT/US22/14969, filed Feb. 2, 2022.

*Primary Examiner* — Michael D Dennis

(57) ABSTRACT

The golf club head described herein can have a metal body and a non-metal insert. The insert forms an entire toe end of the club head. The insert can have an offset surface, located behind the strike face of the body, wherein the insert and strike face form a gap therebetween. The insert offset surface can comprise a backstop that temporarily restricts bending of a center of the strike face during a golf ball impact. The gap between the strike face and the insert allows the strike face to flex while the backstop prevents the strike face from over flexing. In one embodiment, the golf club head can comprise a body having an interior cavity that opens towards a toe end. The insert can form an outermost surface of the toe end and fill a portion of the cavity.

17 Claims, 14 Drawing Sheets

(56) References Cited

U.S. PATENT DOCUMENTS

| | | | | |
|---|---|---|---|---|
| 2019/0118049 | A1* | 4/2019 | Tassistro | B21K 17/00 |
| 2019/0168087 | A1* | 6/2019 | Martens | A63B 53/0466 |
| 2019/0262673 | A1 | 8/2019 | Clarke | |

* cited by examiner

GOLF CLUB HEAD WITH INSERT

CROSS REFERENCE TO RELATED APPLICATIONS

This claims the benefit of U.S. Provisional Patent Appl. No. 63/144,871, filed on Feb. 2, 2021, and U.S. Provisional Patent Appl. No. 63/203,754, filed on Jul. 29, 2021. The contents of all the above-described disclosures are incorporated fully herein by reference in their entirely.

FIELD

The present disclosure relates generally to golf equipment, and more particularly, to iron-type golf club heads methods to manufacture iron-type golf club heads. The present disclosure also relates to multi-material golf club heads and methods to manufacture multi-material golf club heads.

BACKGROUND

Typically, iron-type golf clubs are designed to cater to golfers with a specific skill level. For example, game-improvement iron-type golf club heads can have very flexible faces, to improve potential ball speed, and can be highly forgiving, to improve the aim of off-center shots. Cavity-back irons are one variety of game-improvement iron. On the other end of the spectrum, tour irons can be designed for highly skilled golfers. Tour irons typically have a smaller footprint than game-improvement irons and often have a solid metal construction. Tour irons are less forgiving but allow skilled golfers to shape their shots.

Hollow body irons mix the solid aesthetic design of a tour iron with the forgiveness of a game-improvement iron. However, hollow body irons can have unpleasant acoustics and can be challenging to construct efficiently. There is a need in the art for a golf club head with a simple construction, pleasing acoustics, high forgiveness through pinpointed weighting, and performance characteristics that lead to greater shot accuracy.

DEFINITIONS

Figure 1:
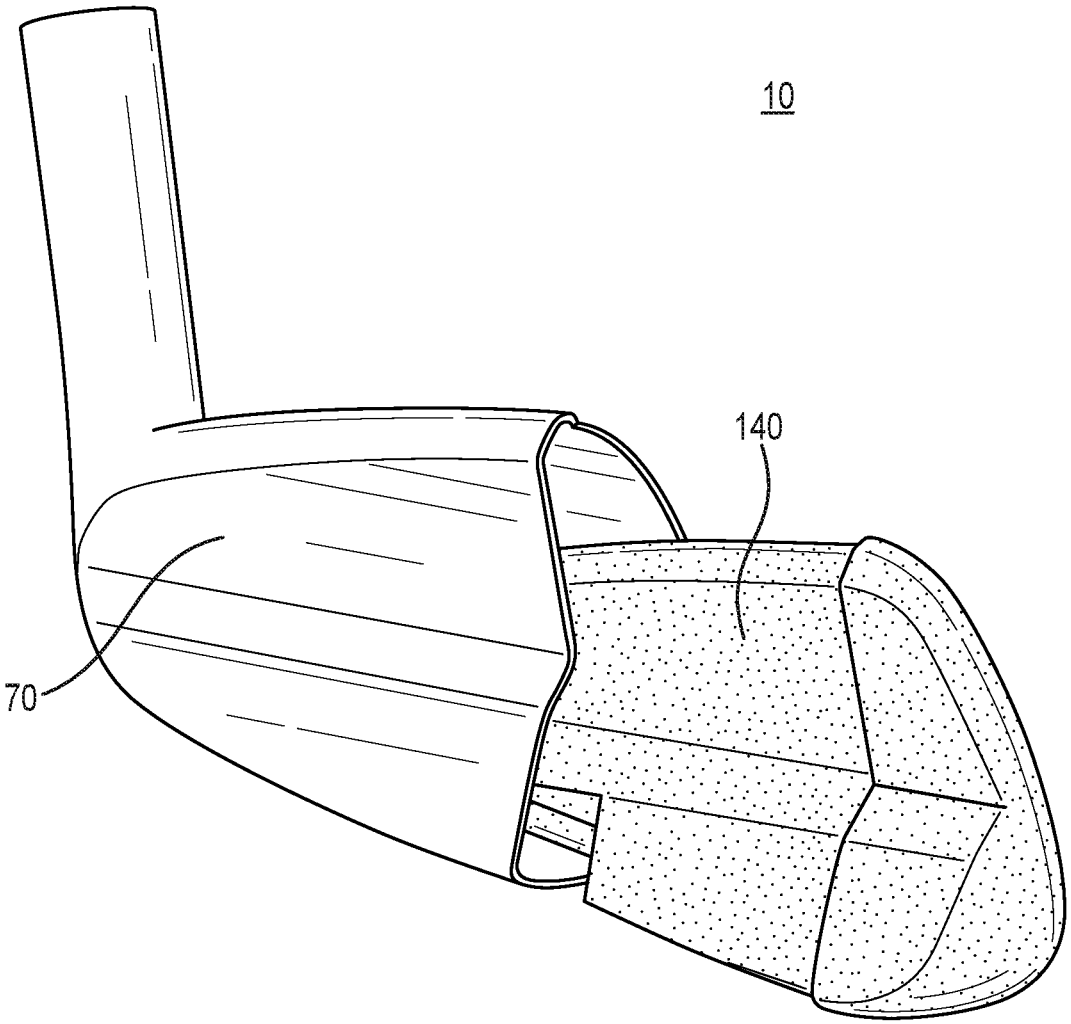
FIG. 1 shows a perspective, exploded view of a golf club head comprising a body and an insert according to a first embodiment.

The terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling (whether mechanical or otherwise) can be for any length of time, e.g., permanent or semi-permanent or only for an instant.

The terms "golf club head," "iron type golf club head," or "iron," as used herein, refers to an iron type golf club head. Specifically, the iron type golf club head can be a muscle back iron, a cavity back iron, a blade style iron, a hollow body iron, a cavity back muscle iron, a high moment of inertia iron, a wedge, a cast iron, a forged iron, or any other iron type golf club head. A standard set of irons can comprise a 3, 4, 5, 6, 7, 8, 9, and pitching wedge (PW).

The term "strike face," "face panel," as used herein, refers to a golf club head front surface that is configured to strike a golf ball. The term strike face can be used interchangeably with "club face," "face panel."

The term "strike face perimeter," as used herein, can refer to an edge of the strike face. The strike face perimeter can be located along an outer edge of the strike face where the curvature deviates from a bulge and/or roll of the strike face.

The terms "geometric centerpoint," "geometric center," "face center," as used herein, can refer to a geometric centerpoint of the strike face perimeter, and at a midpoint of a club face height of the strike face. In the same or other examples, the geometric centerpoint also can be centered with respect to an engineered impact zone, which can be defined by a region of grooves on the strike face. In another approach, the geometric centerpoint of the strike face can be located in accordance with the definition of a golf governing body such as the United States Golf Association (USGA). For example, the geometric centerpoint of the strike face can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibility-Of-A-Golf-Club-Head/) (the "Flexibility Procedure").

The term "ground plane," as used herein, can refer to a reference plane associated with the surface on which a golf ball is placed. The ground plane can be a horizontal plane tangent to a sole of a golf club head at an address position.

The term "loft plane," as used herein, can refer to a reference plane that is tangent to the geometric centerpoint of the strike face.

The terms "loft" or "loft angle" of a golf club as used herein refers to the angle formed between the strike face and the shaft, as measured by any suitable loft and lie machine.

An iron can comprise a loft angle less than approximately 60 degrees, less than approximately 59 degrees, less than approximately 58 degrees, less than approximately 57 degrees, less than approximately 57 degrees, less than approximately 56 degrees, less than approximately 55 degrees, less than approximately 54 degrees, less than approximately 53 degrees, less than approximately 52 degrees, less than approximately 51 degrees, less than approximately 50 degrees, less than approximately 49 degrees, less than approximately 48 degrees, less than approximately 47 degrees, less than approximately 46 degrees, less than approximately 45 degrees, less than approximately 44 degrees, less than approximately 43 degrees, less than approximately 42 degrees, less than approximately 41 degrees, less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, less than approximately 30 degrees, less than approximately 29 degrees, less than approximately 28 degrees, less than approximately 27 degrees, less than approximately 26 degrees, less than approximately 25 degrees, less than approximately 24 degrees, less than approximately 23 degrees, less than approximately 22 degrees, less than approximately 21 degrees, less than approximately 20 degrees, less than approximately 19 degrees or less than approximately 18 degrees.

In other embodiments, the iron can comprise a loft angle greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, greater than approximately 25 degrees, greater than approximately 26 degrees, greater than approximately 27 degrees, greater than approximately 28 degrees, greater than approximately 29 degrees, greater than approximately 30 degrees, greater than approximately 31 degrees, greater than approximately 32 degrees, greater than approximately 33 degrees, greater than approximately 34 degrees, greater than approximately 35 degrees, greater than approximately 36 degrees, greater than approximately 37 degrees, greater than approximately 38 degrees, greater than approximately 39 degrees, greater than approximately 40 degrees, greater than approximately 41 degrees, greater than approximately 42 degrees, greater than approximately 43 degrees, greater than approximately 44 degrees, greater than approximately 45 degrees, greater than approximately 46 degrees, greater than approximately 47 degrees, greater than approximately 48 degrees, greater than approximately 49 degrees, greater than approximately 50 degrees, greater than approximately 51 degrees, greater than approximately 52 degrees, greater than approximately 53 degrees, greater than approximately 54 degrees, greater than approximately 55 degrees, greater than approximately 56 degrees, greater than approximately 57 degrees, greater than approximately 58 degrees, greater than approximately 59 degrees, or greater than approximately 60 degrees.

"Volume" of an iron as used herein, can be measured as a displaced volume enclosed by an outer surface of the club head. In some embodiments, the volume of the golf club head can be less than approximately 45 cc, less than approximately 40 cc, less than approximately 35 cc, less than approximately 30 cc, or less than approximately 25 cc. The total volume of the club head can range inclusively from 30 cc and 45 cc. In other embodiments, the volume of the club head can be approximately 31 cc-38 cc (1.9 cubic inches to 2.3 cubic inches), approximately 31 cc-33 cc, approximately 33 cc-35 cc, approximately 35 cc-37 cc, approximately 37 cc-39 cc, or approximately 35 cc-45 cc. In one example, the golf club head can be 39 cc (2.4 cubic inches). The volume of the golf club head can range inclusively from 25 cc and 35 cc. In other embodiments, the volume of the club head 210 can be approximately 25 cc-30 cc (1.9 cubic inches to 2.3 cubic inches).

"Mass" of an iron as used herein, can be a mass ranging inclusively from 240 grams (g) to 400 grams (g). In one example, the mass can be 260 g. In other embodiments, mass of the golf club head can range inclusively from 230 grams (g) to 300 grams (g). In another example, the mass can be approximately 250 g.

DETAILED DESCRIPTION

Described herein is a golf club head with a multi-material construction, that provides high potential ball speed and shot accuracy. The golf club head comprises a body and an insert made from a lightweight material, such as a polymeric composite. The insert can be a toe insert that forms an outer surface of the club head. The toe insert partially forms a top rail, a rear, a sole, and a toe end of the club head. The top rail, the rear, and the sole can be formed from multiple materials. The toe end or toe of the club head is formed by the toe insert. The toe insert can be exposed on the outer surface of the club head such that the toe insert forms an outermost surface of the toe end. The body does not form the outermost surface of the toe end.

Further, the insert can be set apart from a rear surface of the face by a gap distance. The gap distance provides room for the face panel to flex during impact, thus preserving potential ball speed. However, to balance the potential ball speed benefits with durability, the insert also comprises a backstop to prevent the face panel from over-flexing. Typically, the center of a face is most likely to over-flex at impact, causing structural failure in thin, unsupported strike faces. The backstop on the herein described insert can temporarily contact and stops the center of the strike face from over flexing to prevent strike face durability issues. The backstop also results in a more uniform impact response across the strike face. Other insert features, such as a flex-controlling surface, can alter face bending properties to improve potential shot accuracy.

The golf club head, as described herein, is an iron type golf club head. The body can be a cast or forged metallic part, whereas the insert can be formed from a low-density material, such as a polymeric composite. The body can comprise a thin face panel, forming a strike face, that allows for high potential ball speed. The body can partially define a cavity or other geometries, such as channels, for receiving or mechanically locking the insert to the body. The insert can form a portion of the perimeter of the club head and can fill or cover a central region of the club head. In particular, the insert can form a portion of the toe end and/or top rail, and a part of the insert can be positioned behind the face panel. There can be a gap between the insert and a rear surface of the face panel. The insert can comprise a protruding backstop that is closer to the face panel rear surface than the remainder of the insert. The insert gap and backstop gap distances control the bending of the face panel during dynamic impact. In this way, the insert allows for maximum strike face flexing without reaching a material failure thereby preventing durability issues for the thin face panel. The placement and shaping of the backstop can also increase the uniformity of the impact response across the strike face.

I. Toe Insert Embodiment

Figure 4:
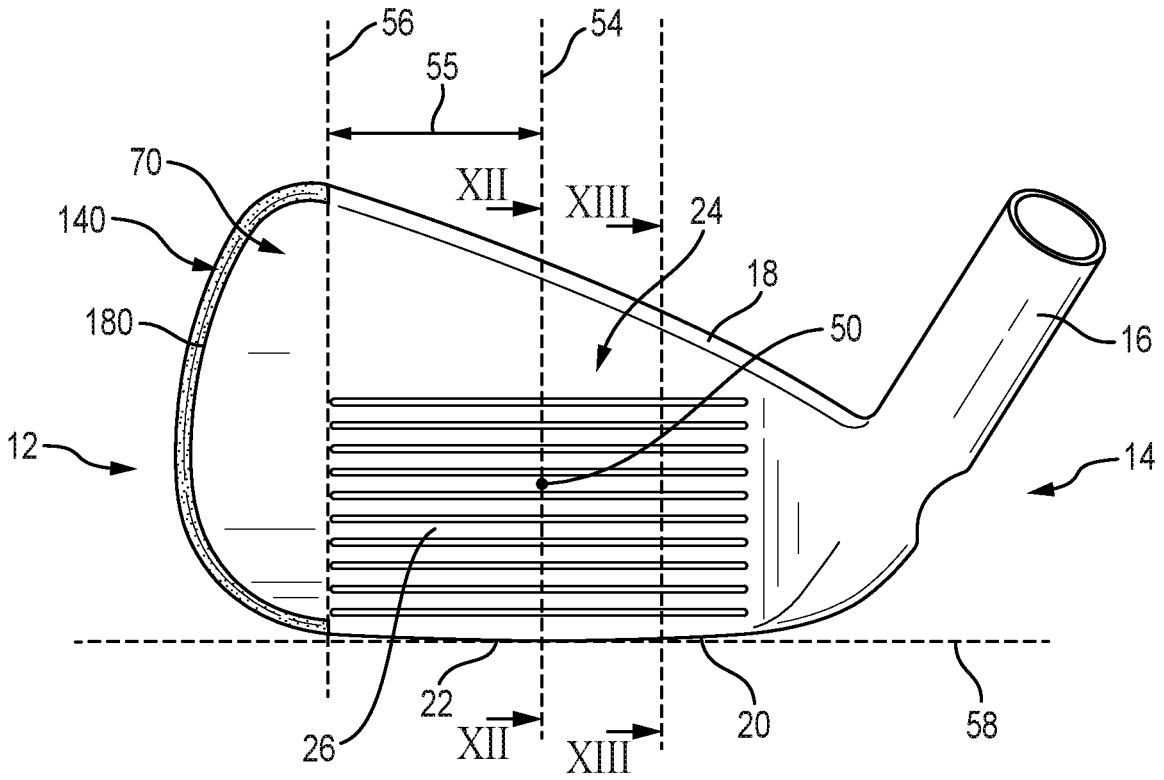
FIG. 4 shows a front view of the golf club head of FIG. 1.
Figure 5:
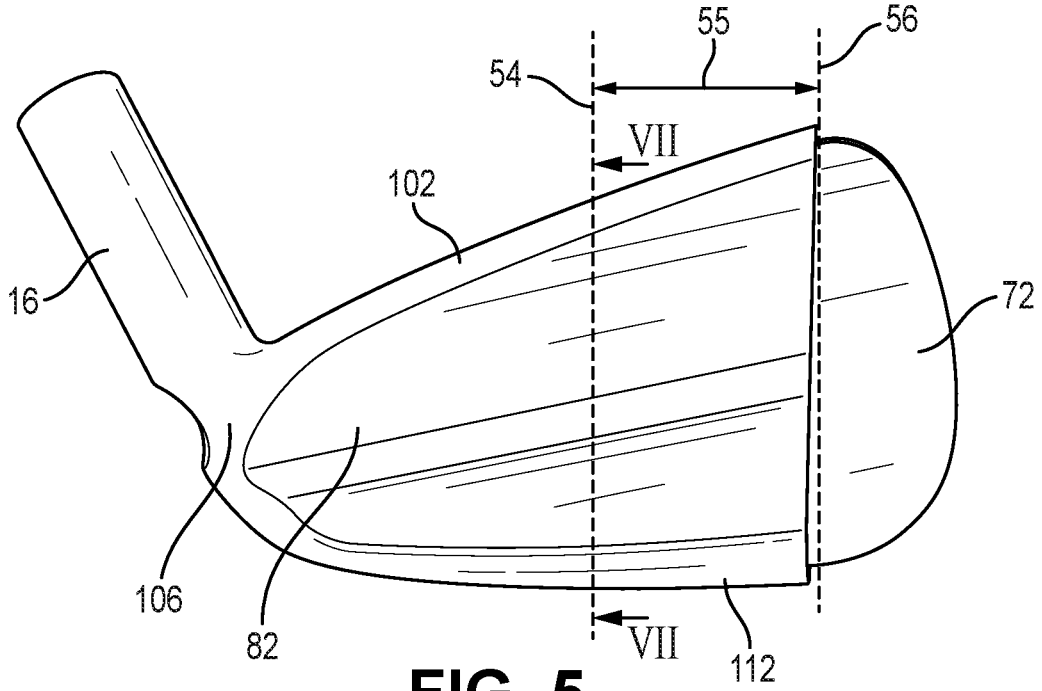
FIG. 5 shows a rear view of the body of the golf club head of FIG. 1 with the insert removed.

Referring to the drawings, FIGS. 1-13 illustrate a first embodiment of a multi-material golf club head 10 comprising a body 70 and an insert 140. The club head 10 can be a hollow body iron. In other words, the club head 10 can be a hollow body iron with a toe end insert 140. The toe end insert 140 can be exposed at the outer surface of the club head 10. The club head 10 comprises a toe end 12, a heel end 14 opposite the toe end 12, a hosel 16 connected to the heel end 14, a top rail 18, a sole 20 opposite the top rail 18, a strike face 26, and a rear 28. The toe end insert 140 partially forms the top rail 18, the sole 20, and the rear 28. The toe end insert 140 forms the toe end 12 and the outermost surface of the toe end 12 (i.e. toemost surface of the club head 10). Referring to FIGS. 4 and 7, the strike face 26 defines a geometric center 50. FIG. 7 illustrates a ground plane 58 tangent to the sole when the club head is at an address position. The club head 10 defines a loft plane 60 that lies tangent to a geometric center 50 of the strike face 26. A geometric center reference axis 52 extends through the geometric center 50 and is normal to the strike face 26. FIGS. 4 and 5 illustrate a center reference plane 54 that is perpendicular to a ground plane 58 and coincident with the geometric center reference axis 52. A vertical reference plane 56 extends through the golf club head 10 in a front-to-rear direction and perpendicular to the ground plane 58. In other words, the vertical reference plane 56 is parallel to the center reference plane 54. An offset position of the vertical reference plane 56 from the center reference plane 54 can assist with identifying the location of certain club head features, as described below.

Figure 3:
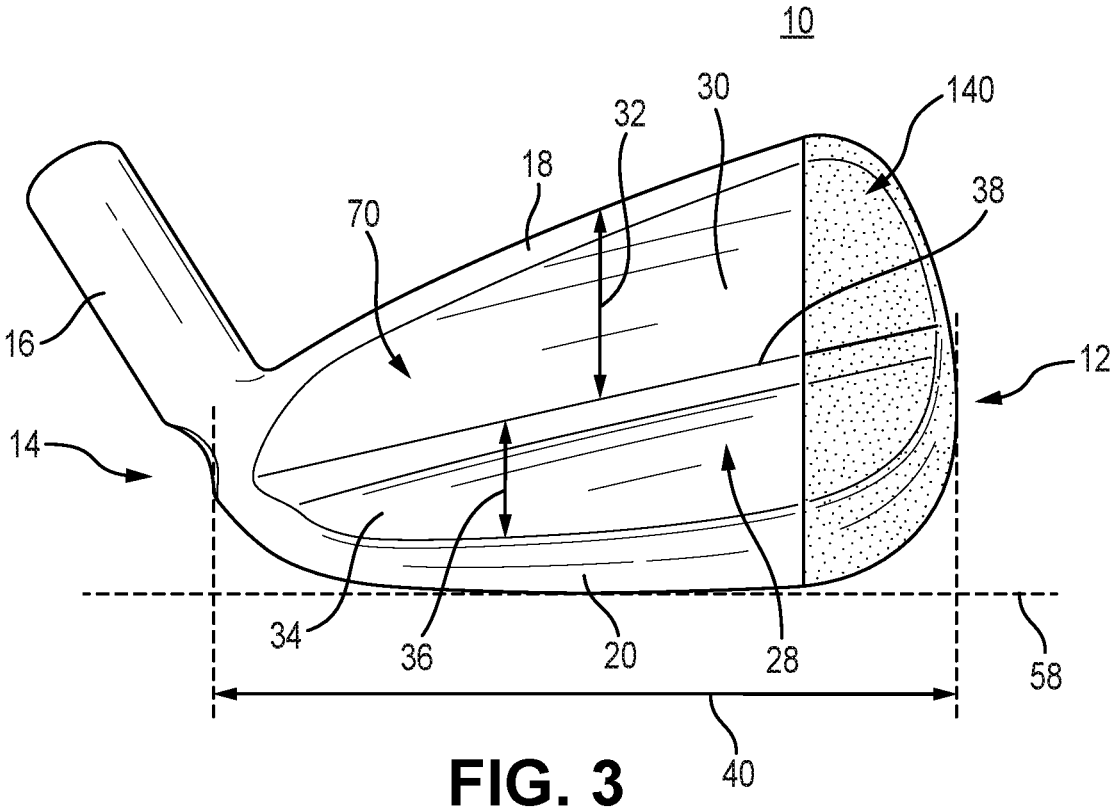
FIG. 3 shows a rear view of the golf club head of FIG. 1.

Referring to FIG. 3, the club head 10 comprises a length 40, measured parallel to the ground plane 58 in a direction from the heel end 14 towards the toe end 12. The length 40 can range from 3.0 to 4.0 inches. The length 40 can be 3.0, 3.1, 3.2, 3.3, 3.4, 3.5, 3.6, 3.7, 3.8, 3.9, or 4.0. In one example, the length 40 of the golf club head is approximately 3.5 inches.

The body 70 can be formed from a metal. Specifically, the body 70 can be formed from a steel alloy selected from the group consisting of: 450 steel, C250 steel, NiMark 250 steel, 475 steel, and 17-4 steel. In other embodiments, the body 70 can comprise a metallic alloy other than a steel alloy. The body 70 comprises a first density greater than a second density of the insert 140. In other words, the second density of the insert 140 is less than the first density of the body 70.

The insert 140 can be formed from a non-metal. Specifically, the insert 140 can be formed from a polymeric resin and reinforcing fibers. The insert 140 can be a polymeric composite. The polymeric resin can be a thermoplastic, such as a thermoplastic elastomer (TPE) or a thermoplastic polyurethane (TPU). The reinforcing fibers can be carbon fibers (sometimes called graphite fibers), fiberglass, aramid fibers, such as Kevlar®, or boron fibers. In other embodiments, the reinforcing fibers can be natural fibers, including but not limited to fibers from jute, flax, ramie, hemp, sugar cane, coir, sisal, grass, and abaca plants. The reinforcing fibers can be short fibers or long fibers. The reinforcing fibers can be randomly oriented within the composite. The insert 140 can be injection molded. In other embodiments, the insert 140 can also comprise a lightweight metal alloy, such as an aluminum or magnesium alloy.

i. Body

Figure 2:
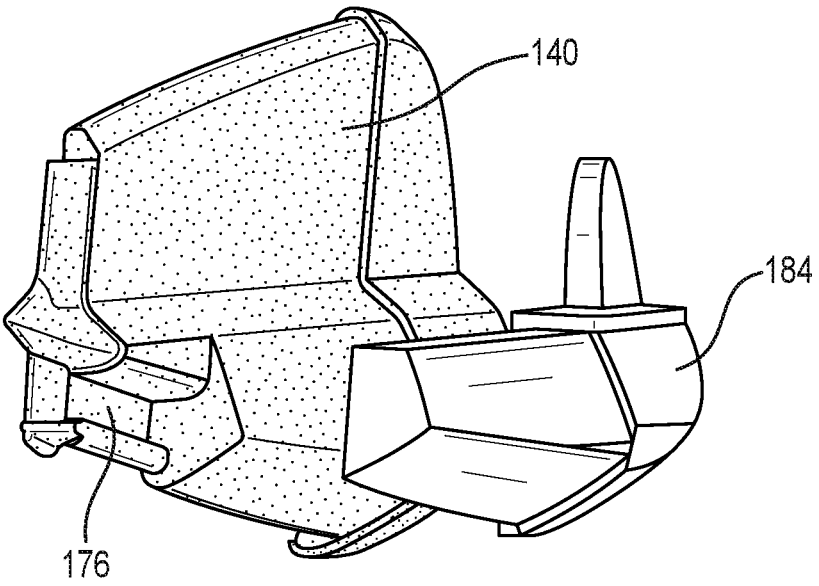
FIG. 2 shows a perspective, exploded view of the insert and an internal weight configured to fit within the insert of FIG. 1 with the body removed.

FIGS. 1-3 illustrate the club head 10 comprising the tubular body 70 configured to house the insert 140. The body 70 forms a majority of the club head 10. The body 70 defines an interior cavity 124. The body 70 of the golf club head 10 comprises a face panel 72, a rear portion 82, a top wall 102, a sole portion 112 including a thick sole portion 114 and a thin sole portion 118, a hosel transition portion 106, and a cylindrical hosel 16. The rear portion 82 is opposite the face panel 72 and forms part of the rear 28 of the club head 10. The top wall 102 forms part of the top rail 18 of the club head 10. The top wall 102 connects the face panel 72 and the rear portion 82 at a top of the club head 10. The sole portion 112 connects face panel 72 and the rear portion 82 at a bottom of the club head 10. The face panel 72, rear portion 82, top wall 102, and thick and thin sole portions 114, 118, respectively, blend into the hosel transition portion 106. The hosel transition portion 106 connects to the cylindrical hosel 16. The body 70 is configured to receive and support an insert 140 as described in more detail below.

Figure 6:
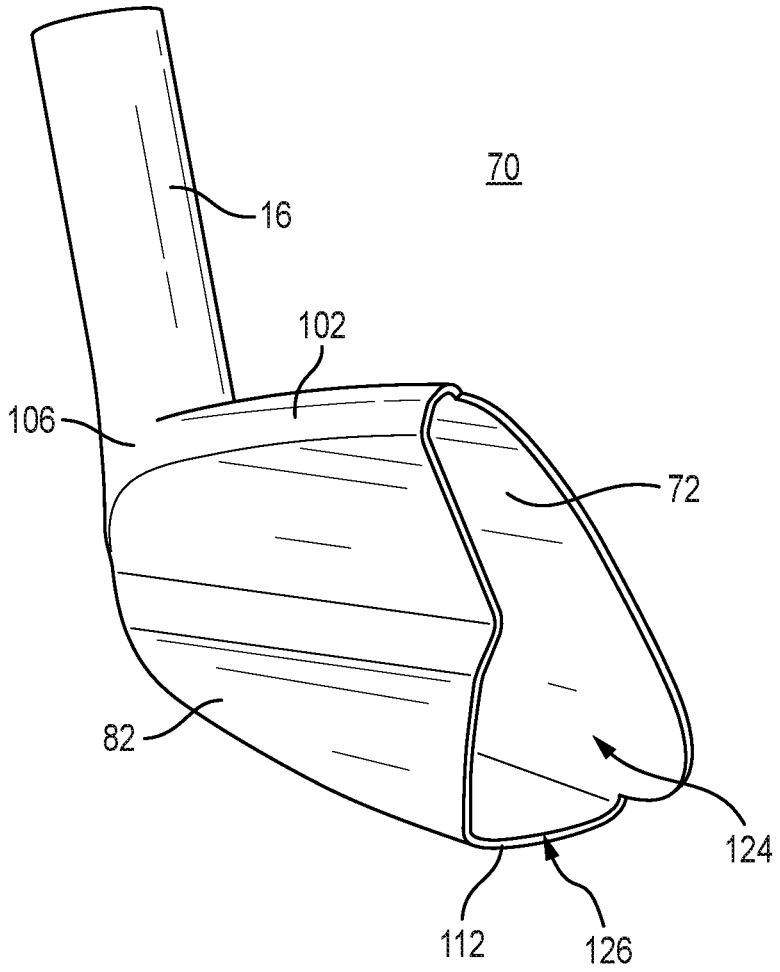
FIG. 6 shows a rear perspective view of the body of FIG. 5 with the insert removed.
Figure 7:
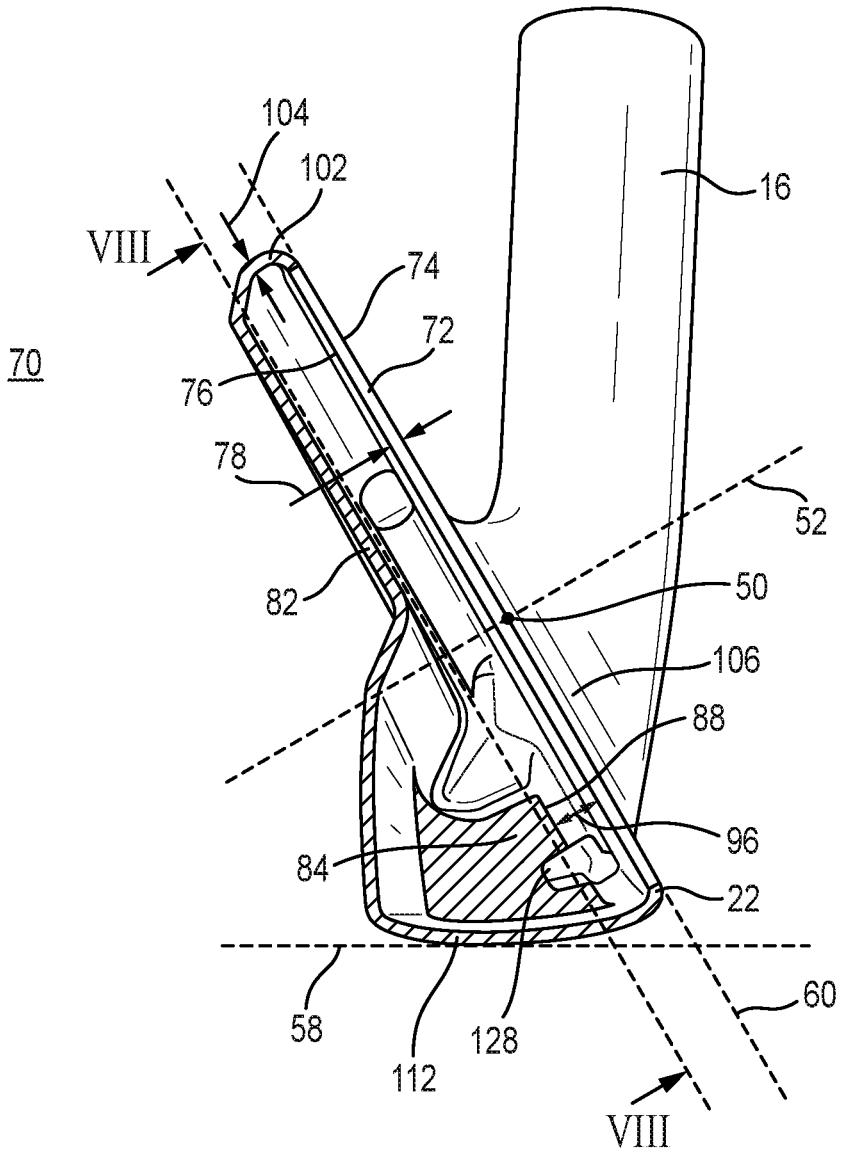
FIG. 7 shows a cross-sectional view of the body of FIG. 5, taken along line VII-VII of FIG. 5.

Referring to FIGS. 5-7, the body 70 comprises the face panel 72 having a front surface 74 and a rear surface 76. The front surface 74 of the face panel 72 can form the entirety of the strike face 26 of the club head 10. The rear surface 76 of the face panel 72 is opposite the front surface 74. The rear surface 76 faces the interior cavity 124 of club head 10. When the golf club head 10 impacts a golf ball, the rear surface 76 can bend and temporarily contact a portion of the insert 140 which is located behind the rear surface 76.

Referring to FIG. 7, the face panel 72 comprises a thickness 78 measured between the front surface 74 and the rear surface 76. The face panel 72 can have a uniform thickness. The face panel 72 can comprise a constant thickness. The face panel 72 can comprise a constant thickness as measured across the strike face 26 in a heel to toe direction, and a top rail to sole direction. The face panel thickness 78 can range between 0.055 inch to 0.10 inch. In other embodiments, the face panel thickness 78 can range between 0.055 inch to 0.075 inch, 0.065 inch to 0.085 inch, 0.075 inch to 0.095 inch, or 0.080 inch to 0.1 inch. In other embodiments still, the face panel thickness 78 can be less than 0.060 inch, less than 0.065 inch, less than 0.070 inch, less than 0.08 inch, less than 0.09 inch, or less than 0.10 inch. For example, the face panel thickness 78 can be 0.055, 0.06, 0.061, 0.065, 0.07, 0.075, 0.08, 0.085, 0.09, or 0.10 inch. In one example, the face panel thickness 78 can be approximately 0.055 inch. In another example, the face panel thickness 78 can be approximately 0.065 inch. The thin face panel 78 promotes face bending thereby increasing ball speed.

Referring to FIG. 4, the face panel front surface 74 can comprise grooves for improving the grip of the golf ball against the face panel 72 during impact. The grooves can extend in a heel-to-toe direction. The face panel front surface 74 can comprise 5 to 20 grooves. In some embodiments, the face panel front surface 74 can comprise 15 to 18 grooves. The face panel 72 can be integrally formed with the body 70. In other embodiments, the face panel 72 can be a separate faceplate welded onto the body 70.

Referring to FIG. 6, the body 70 can be generally tubular, defining the interior cavity 124. The tubular body 70 defines a hollow structure comprising the interior cavity 124. The tubular body 70 can be bounded by the face panel 72, the heel end 14, the rear 28, the sole 20, and the top rail 18. In other words, the tubular body 70 can be a hollow shell that is bounded by the face panel 72, the heel end 14, the heel end 14, the rear 28, the sole 20, and the top rail 18. However, as illustrated in FIG. 5, the face panel 72 can extend further towards the toe end 12 than any other portion of the body 70. The body 70 forms no portion of an outermost surface of the toe end 12. Referring to FIGS. 1 and 5-7, the interior cavity 124 opens towards the toe end 12 of the club head 10. FIG. 6 illustrates a mouth 126 of the interior cavity 124. FIG. 5 illustrates the mouth of the interior cavity 124 positioned at the vertical reference plane 56. The cavity mouth 126 points towards the toe end 12 of the club head 10. The cavity mouth 126 can be an entrance to the interior cavity 126. The cavity mouth 126 can be an access to the interior cavity 126. The cavity mouth 126 is not visible from one or more of a direct rear view, front view, sole view, and top view. The cavity mouth 126 is never visible from a heel view. The body 70 can be shaped so that the interior cavity 124 has a cross-sectional area, taken parallel to the vertical reference plane 56, that is largest at its mouth 126. In some embodiments, the body 70 can be shaped so that the cavity 124 has a cross-sectional area that gets progressively smaller towards the heel end 14. This cavity shaping allows the insert to be pre-formed and then slid into the cavity 124 without hindrance. Additionally, in some embodiments, a heel boundary of the interior cavity 124 can be located from approximately 0.9 inch to 1.5 inches away from the center reference plane 54 towards the heel end 14. For example, the heel boundary of the interior cavity 124 can be located approximately 0.9 inch to 1 inch, 1 inch to 1.1 inches, 1.1 inches to 1.2 inches, 1.2 inches to 1.3 inches, 1.3 inches to 1.4 inches, or 1.4 inches to 1.5 inches from the center reference plane 54 towards the heel end 14. In some embodiments, the heel boundary of the interior cavity 124 can be located approximately 1.1 inches away from the center reference plane 54 towards the heel end 14. The volume and length of the interior cavity 124 is important for insert 140 positioning behind the strike face 26.

The face panel rear surface 76, the rear portion 82, the top wall 102, and the sole portion 112 together define (or bound) the interior cavity 124. The face panel rear surface 76 can form a forward boundary of the interior cavity 124. The rear portion 82 can form a rear boundary of the cavity 124. The top wall 102 can form a ceiling of the cavity 124. The thick and thin sole portions can form a bottom boundary of the cavity 124. In some embodiments, the hosel transition portion 106 can define a heel-side boundary of the cavity 124. In some embodiments, the cavity 124 extends partially into the hosel transition portion 106.

The interior cavity 124 can comprise a volume. The cavity volume can range between 0.65 cubic inch and 0.90 cubic inch. For example, the cavity volume can be 0.86 cubic inches. In some embodiments, the cavity volume can range between 25% and 40% of the total volume of the club head 10. In some embodiments, the cavity volume can range between 25% and 30%, 30% and 35%, or 35% and 40% of the total club head volume. For example, the cavity volume can be 25%, 26%, 27%, 28%, 29%, 30%, 31%, 32%, 33%, 34%, 35%, 36%, 37%, 38%, 39%, or 40% of the total club head volume.

FIG. 3 illustrates an upper rear surface 30 and a lower rear surface 34 divided by a crease 38 (also called a cross section inflection point or bending line). The crease 38 extends from the toe end 12 to the heel end 14 and is located between the top rail 18 and the sole 20. The crease 38 allows the rear 28 to flex when the club head 10 impacts a golf ball. The upper rear surface 30 can have a height 32, measured normal to the ground plane 58. The upper rear surface height 32 can be greater than a lower rear surface height 36. The upper rear surface height 32 can increase from near the heel end 14 to near the toe end 12. The lower rear surface height 36 can increase from near the heel end to near the toe end 12. When the golf club head 10 is at address, the crease 38 can be closer to the ground plane 58 near the heel end 14 than it is near the toe end 12.

Referring to FIGS. 5 and 6, the face panel 72 can extend further towards the toe end 12 of the club head 10 than the remaining portions of the body 70. The top wall 102, the rear portion 82, and the sole portion 112 extend towards the toe end 12 no further than the vertical reference plane 56. The vertical reference plane 56 can be offset from the center reference plane 54 towards the toe end 12 of the club head by an offset distance 55. The offset distance 55 can range between 1.0 inch and 1.8 inches. For example, the offset distance 55 can be 1.4 inches. In alternate embodiments, the offset distance 55 can range between 0 inch and 1.8 inches. As a consequence of the termination of the top wall 102, the rear portion 82, and the sole portion 112 at or before the vertical reference plane 56, the cavity of the body also terminates on a heel-side of the vertical reference plane 56. The offset distance 55 allows the body 70 of the club head 10 to be formed to provide optimal positioning of the insert 140 and insert 140 backstop behind the face panel 72 as described below.

In some embodiments, the top wall 102, the rear portion 82, and the sole portion 112 of the body 70 do not extend within 0.2 inch, 0.4 inch, 0.6 inch, 0.8 inch, 1.0 inch, 1.2 inch, or 1.4 inch from an outermost point or surface on the club head toe end 12. In contrast, the face panel 72 can extend almost to or fully to the toe end 12. The offset of the body 70 from the outermost surface of the toe end 12 allows the insert 140 to form the remaining portions of the top wall 102, the rear portion 82, the sole portion 112, and toe end 12.

Referring to FIG. 7, the thickness of the top wall 102 and the sole portion 112 can affect the face panel's 72 ability to bend during dynamic impact with a golf ball. The top wall 102 can comprise a thickness 104 ranging inclusively from 0.030 inch to 0.040 inch. In some embodiments, the top wall thickness 104 can range inclusively from 0.030 inch to 0.032 inch, 0.032 inch to 0.034 inch, 0.034 inch to 0.036 inch, 0.036 inch to 0.038 inch, or 0.038 inch to 0.040 inch. The thin top wall 102 can promote strike face flexing. The above described thickness of the top wall 102 and the sole portion 102 allows for weight savings while providing strength to the club head 10 to withstand golf ball impacts.

Figure 8:
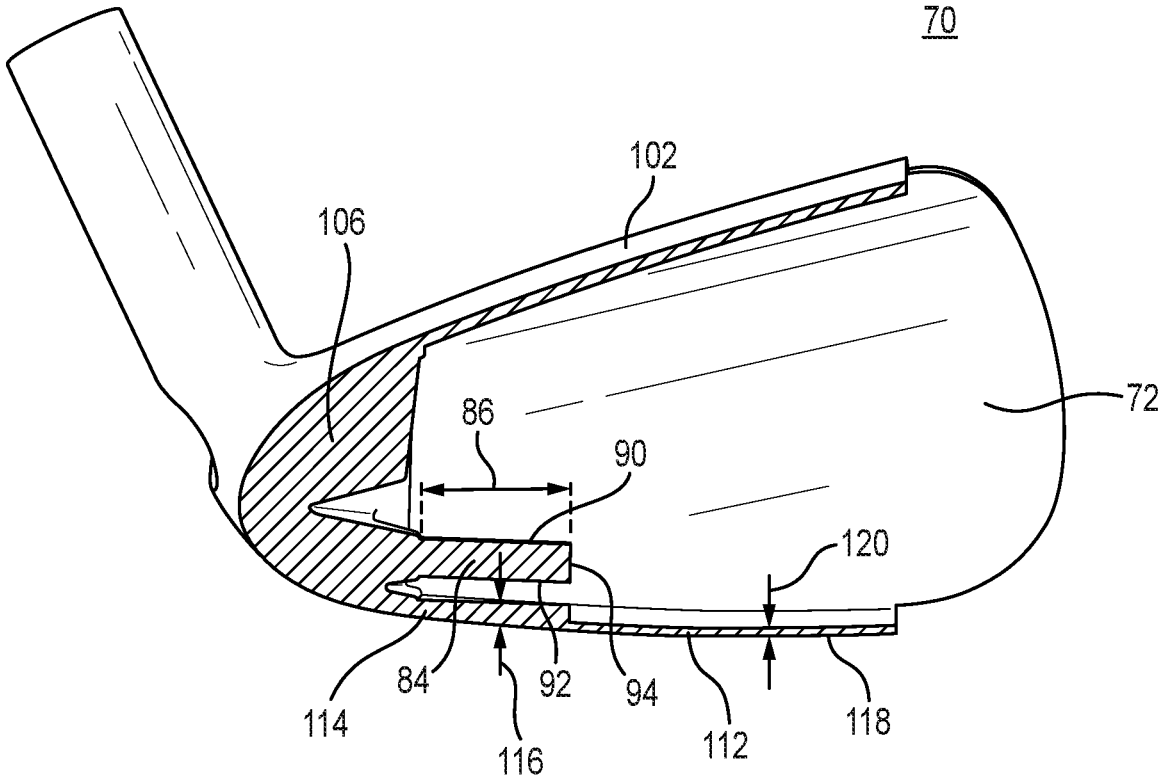
FIG. 8 shows a cross-sectional view of the body of FIG. 5, taken along line VIII-VIII of FIG. 7.

Referring to FIG. 8, the sole portion 112 comprises the thick sole portion 114 and the thin sole portion 118. The thick sole portion 114 can be behind the thin sole portion 118 when viewing the interior cavity 124 in a front-to-rear direction. The thick sole portion 114 does not extend across the entire sole 20. For example, the thick sole portion 114 can be located primarily on a heel side of the central reference plane 54. The thick sole portion 114 helps improve mass properties by distributing more weight in a down and back position and also provides structure for interlocking geometry for an insert 140. The thin sole portion 118 connects to the face panel 72 at the leading edge 22 of the sole 20. Positioning the thin sole portion 118 directly behind the leading edge 22 promotes flexing of the strike face 26. The thin sole portion 118 helps promote greater strike face flexion upon impact with a golf ball. The thin sole portion 118 can comprise a thickness 120 ranging from 0.030 inch to 0.075 inch. In some embodiments, the thin sole portion thickness 120 can range from 0.030 inch to 0.05 inch, or 0.05 inch to 0.075 inch. In other embodiments, the thin sole portion thickness 120 can range from 0.030 inch to 0.045 inch, 0.045 inch to 0.06 inch, or 0.06 inch to 0.075 inch. In one example, the thin sole portion thickness 120 can approximately 0.035 inch. The thick sole portion 114 can comprise a thickness 116 greater than the thin sole portion thickness 120. The thick sole portion thickness 116 can range from 0.040 inch to 0.100 inch. In some embodiments, the thick sole portion thickness 116 ranges from 0.040 inch to 0.050 inch, 0.050 inch to 0.060 inch, 0.060 inch to 0.070 inch, 0.070 inch to 0.080 inch, 0.080 inch to 0.090 inch, or 0.090 inch to 0.100 inch. In one example, the thick sole portion thickness 116 can be approximately 0.075 inch.

ii. Insert

Referring to FIGS. 1-3, the golf club head 10 comprises a low-density insert 140 that can temporarily restrict deflection or movement of the face panel 72 during dynamic impact with a golf ball. The insert 140 prevents the face panel 72 from over flexing or flexing to a point of failure. The insert 140 can slide into the interior cavity 124 from the toe end 12 and form a majority of the toe end 12. A portion of the insert 140 can be exposed at the toe end 12 and portions of the rear 28, sole 20, and top rail 18. The insert 140 can form an entire outermost surface of the toe end 12.

Figure 9:
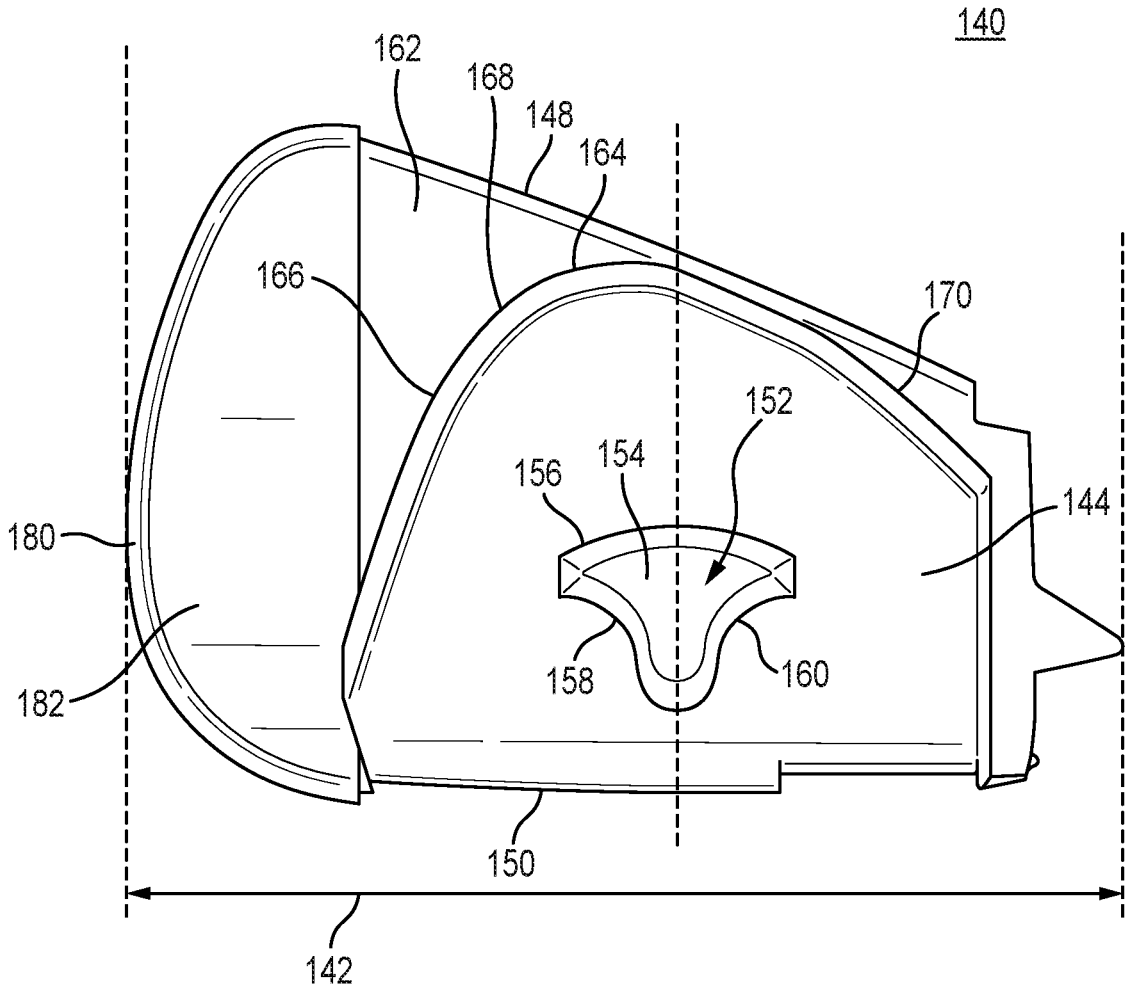
FIG. 9 shows a front view of the insert of the golf club head of FIG. 1.
Figure 10:
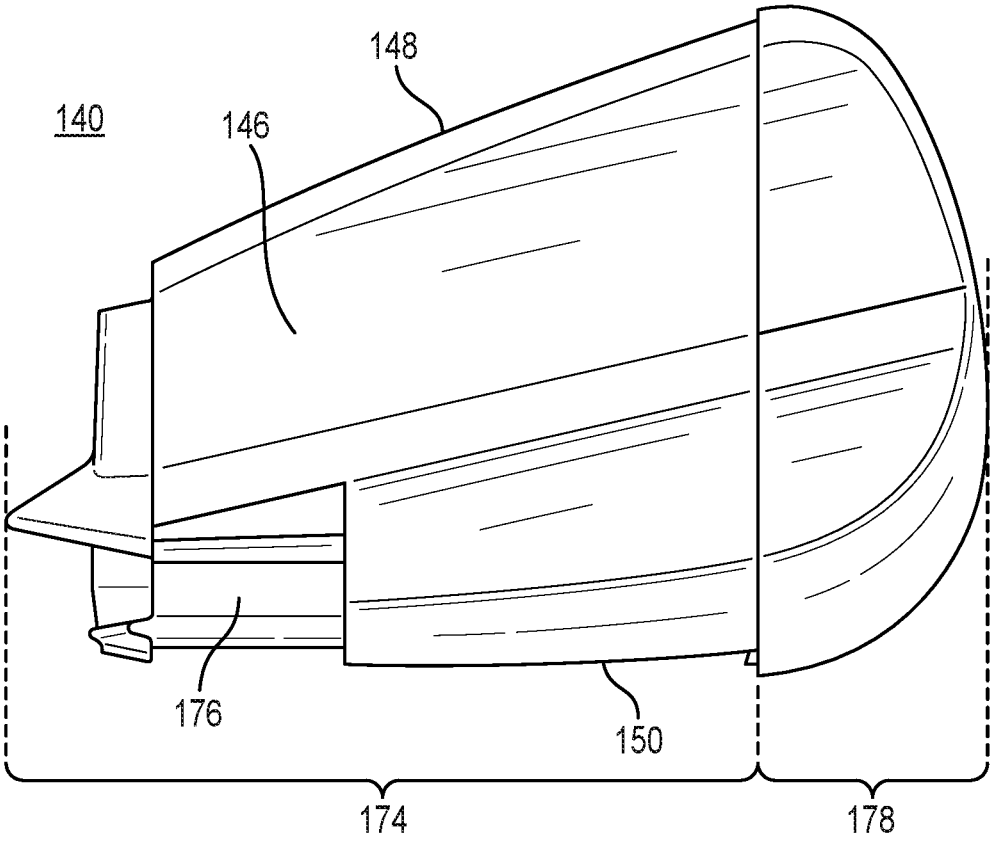
FIG. 10 shows a rear view of the insert of FIG. 9.

FIG. 3 illustrates the insert 140 replacing or forming a portion of the club head perimeter, such as the toe end 12 or the top rail 18. The insert 140 can be configured to attach, couple, and/or slide onto to the body 70. As illustrated in FIGS. 9 and 10, the insert 140 comprises an offset surface 144, a back surface 146 opposite the offset surface 144, a top edge 148, and a bottom edge 150. The insert 140 can at least partially fill an interior cavity of the body 70. The insert 140 can form a portion of the rear 28, the sole, the top rail 18, the toe end 12 of the club head 10. The insert 140 can form a top portion of the toe end 12, a center portion of the toe end 12, and a bottom portion of the toe end 12. The insert 140 can be partially exposed at the toe end 12. The insert 140 can be externally visible from at least a front view, a toe view, and/or a rear view. FIG. 9 illustrates a midplane of the insert 140 can be defined as halfway between the heel end 14 and the toe end 12 of the insert 140 along its length 142.

Figure 12:
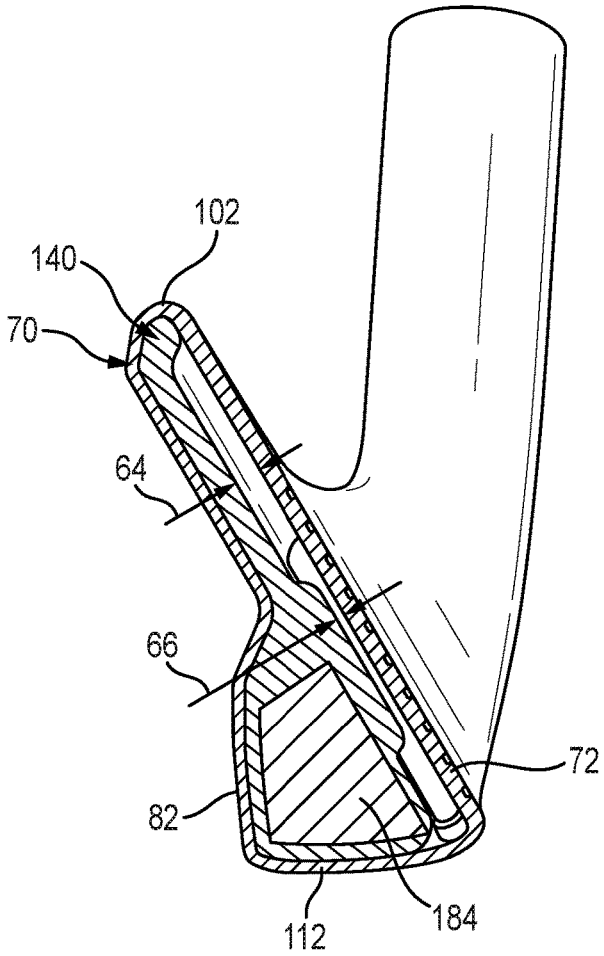
FIG. 12 shows a cross-sectional view of the golf club head of FIG. 1, taken along line XII-XII of FIG. 4.
Figure 13:
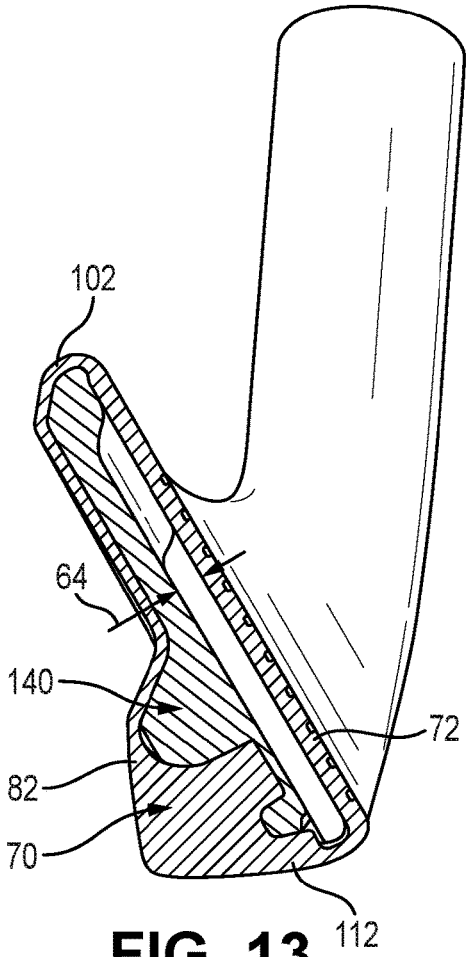
FIG. 13 shows a cross-sectional view of the golf club head of FIG. 1, taken along line XIII-XIII of FIG. 4.
Figure 14:
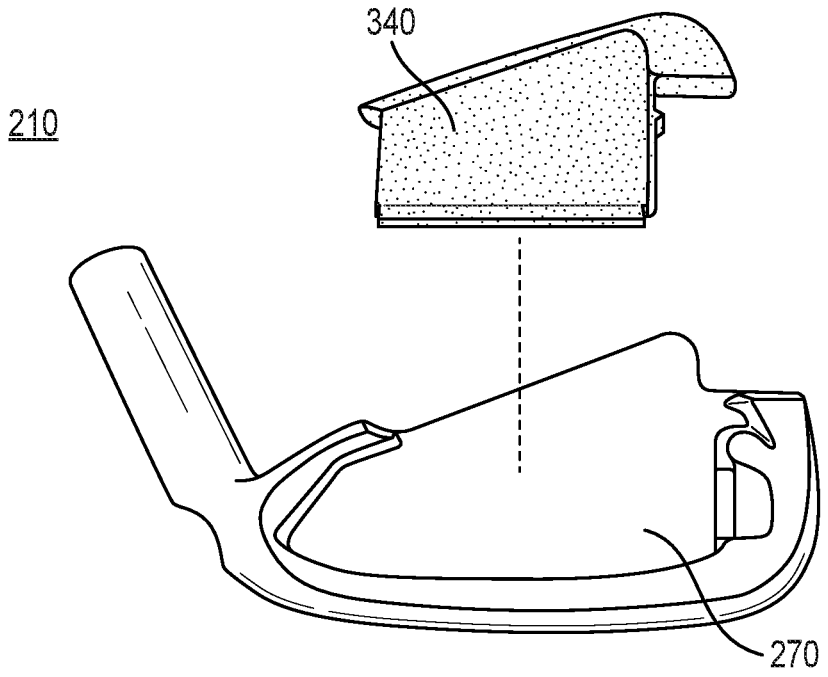
FIG. 14 shows a rear, exploded view of a golf club head comprising a body and an insert according to a second embodiment.

Referring to FIGS. 12 and 13, a gap can form between the offset surface 144 of the insert 140 and the rear surface 76 of the face panel 72. The gap between the insert 140 and the face panel 72 can provide space for the face panel 72 to flex during the golf ball impact. FIG. 12 illustrates a gap distance 64 between the insert offset surface 144 and the face panel rear surface 76 (hereafter "an insert gap distance 64") can range between 0.050 inch and 0.100 inch. In other embodiments, the insert gap distance 64 can range between 0.05 inch to 0.075 inch, or 0.075 inch to 0.100 inch. In other embodiments still, the insert gap distance 64 can range between 0.055 inch and 0.095 inch, 0.055 inch and 0.075 inch, 0.060 inch and 0.090 inch, 0.060 inch and 0.080 inch, or 0.065 inch and 0.075 inch. For example, the insert gap distance 64 can be 0.050, 0.055, 0.060, 0.065, 0.070, 0.075, 0.080, 0.085, 0.090, 0.095, or 0.100 inch. In one example, the insert gap distance 64 can be approximately 0.075 inch. The insert 140 does not contact the face panel 72 at a rest state (i.e. before an impact with the golf ball). In other words, the insert 140 does not lie flush against the face panel 72 during the rest state. During golf ball impacts, the face panel 72 is in a deformed state under the load of the golf ball, wherein the insert 140 contacts the rear surface 76 of the face panel 72 to prevent the face panel 72 from flexing to a point of failure by providing support for a particular force impact flexure of the strike face 26.

The insert 140 comprises an enclosed portion 174 and an exposed portion 178. The enclosed portion 174 and exposed portion 178 of the insert 140 can be integrally formed. The enclosed portion 174 can sit entirely within the cavity 124. The enclosed portion 174 of the insert 140 can be located at least partially on the heel end side of the vertical reference plane 56, defined above. The enclosed portion 174 can be the portion of the insert 140 that is located behind the face panel 72.

The exposed portion 178 can be entirely outside of the cavity 124. The exposed portion 178 of the insert 140 can be located entirely on the toe end side of the vertical reference plane 56. The insert exposed portion 178 can form the toe end 12 of the club head 10 and a section of the rear 28 that is adjacent the toe end 12. The exposed portion 178 is not positioned directly behind the face panel 72. The insert 140 can plug the cavity 124, fully closing off the cavity mouth 126. The insert 140 can plug the entrance or access to the cavity 124. The exposed portion 178 of the insert 140 aligns with an exterior surface of the body 70 to form an exterior surface of the golf club head 10. The insert 140 forms the outermost surface of the toe end 12. The body 70 does not form the toe end of the club head 10 and the outermost surface of the toe end 12 of the club head 10.

The enclosed portion 174 can partially fill the cavity 124 of the body 70. The enclosed portion 174 of the insert 140 can comprise at least one surface that sits flush against interior cavity walls of the body 70, particularly the wall that forms rear 28. However, near the front 24, the gap distance 64 separates the insert 140 from the face panel 72. The enclosed portion 174 of the insert 140 can sit flush at a perimeter of the face panel 72. The insert 140 supporting the perimeter of the face panel 72 allows the insert 140 be spaced from the face panel 72 at the center portion of the face panel 72.

Referring to FIGS. 12 and 13, the top edge 148 of the insert 140 can lie flush against a perimeter of the face panel 72. The top edge 148 can contact the face panel 72 perimeter along a length of the top rail 18 in a heel-to-toe direction. The insert 140 contacts the face panel 72 perimeter while other portions of the insert 140 do not contact the face panel 72 (e.g. a center area or portion of the face panel 72). The insert 140 supports the perimeter of the face panel 72 while not supporting the center portion of the face panel 72 to allow the face panel 72 to flex during golf ball impacts.

Referring to FIGS. 3, 4, 9, and 10, the exposed portion 178, which partially forms the toe end 12, can have an insert front surface 182 and a front lip 180. The front of the exposed portion 178 can be mostly covered by the body face panel 72. The insert front surface 182 lies flush against and directly behind a toe-ward perimeter of the face panel 72. The front lip 180 hugs or wraps up around toe-side perimeter edges of the face panel 72, forming a portion of the perimeter of the club head 10. The front lip 180 extends around and forward from the insert front surface 182. The front lip 182 can support the face panel 72 perimeter at the toe end 12. The front lip 182 does not contact the center portion of the face panel 72. Some alternate embodiments can be devoid of the front lip 180, instead having the front panel 72 extend all the way to the extreme perimeter of the toe end 12.

Referring to FIGS. 3 and 4, the exposed portion 178 can comprise an exterior surface that connects flush to an exterior surface of the body 70. The exposed portion 178 can form percentage of the rear 28 of the club head 10, less than 50%. In some embodiments, the insert exposed portion 178 can form more than 5%, more than 10%, more than 15%, more than 20%, or more than 30% of the rear 28. In some embodiments, the insert 140 forms approximately 25% of the rear 28. For example, the insert 140 can form 0.95 square inches of the rear 28, which can have a total surface area of approximately 3.69 square inches.

The exposed portion 178 can form a percentage of the sole 20 of the club head 10, less than 50%. In some embodiments, the insert exposed portion 178 can form more than 5%, more than 10%, more than 15%, more than 20%, or more than 30% of the sole. In some embodiments, the insert 140 forms approximately 25% of the sole 20. The exposed portion 178 can also form a portion of the top rail 18. As illustrated in FIG. 3, the outer surfaces of the top rail 18, the sole 20, the rear 28 of the assembled club head 10 can be formed from multiple materials. The assembled club head 10 further comprises one material at the toe end 12 or at the outermost surface of the toe end 12. The assembled club head 10 further comprises one material on the strike face 26 or face panel front surface 74. The insert exposed portion 178 can be integrally attached to a toe end of the enclosed portion 174. The insert 140 can be molded as one component, such that both the enclosed and exposed portions 174, 178 are molded from the same material.

Further, less than 35% of the volume of the insert 140 can be located outside the cavity 124. In other embodiments, less than 30%, less than 25%, less than 20%, less than 15%, or less than 10% of the volume of the insert 140 can be located outside the cavity 124. Further, greater than 65% of the volume of the insert 140 can be located within the cavity 124. In other embodiments, greater than 70%, 75%, 80%, 85%, 90%, or 95% of the volume of the insert 140 can located within the cavity 124.

Referring to FIG. 9, the insert 140 can have a length 142, measured in a direction from the heel end 14 to the toe end 12 and parallel to the ground plane 58, between 10% and 80% of the golf club head length 40. In some embodiments, the insert 40 can have a length 142 between 10% and 30%, 10% and 50%, 30% and 70%, 30% and 60%, 30% and 50%, 40% and 50%, 20% and 50%, or 50% and 80%. In some embodiments, the insert 140 has a length 142 that is approximately 50% of the golf club head length 40. The length of the insert 140 provides sufficient length to control the location of the backstop 152 behind the face panel 72.

In some embodiments, the insert 140 can comprise a volume ranging between 1 cubic inch and 6 cubic inches. In one example, the insert volume can be approximately 5 cubic inch. In some embodiments, the insert 140 can have a mass ranging inclusively between 10 g and 20 g. In one example, the insert mass can be approximately 15.8 g. The insert 140 can have a specific gravity that is less than the specific gravity of the body 70.

In some embodiments, the insert 140 can fill a majority of the cavity 124. The insert 140 can fill between 60% and 95% of the cavity 124. In some embodiments, the insert 140 can fill between 70% and 90%, 70% and 80%, 75% and 85%, or 80% and 90% of the cavity 124. For example, the insert 140 can fill approximately 87% of the cavity 124. In some embodiments, the insert enclosed portion 174 can have a volume that ranges between 0.65 and 0.86 cubic inches. The enclosed portion volume corresponds to the filled volume of the cavity 124. Put yet another way, the empty volume of the cavity 124 can range between approximately 0.1 cubic inch and 0.5 cubic inch.

a. Backstop and Flex Controlling Surface

Referring to FIG. 9, the insert can comprise a backstop 152 and a flex-controlling surface 162 that protrudes from (or are disposed on) the insert offset surface 144. The backstop 152 and flex-controlling surface 162 can be configured to temporarily contact the face panel 72 when it bends during dynamic impact. When the golf club 10 is at rest, the backstop 152 does not contact the face panel 72. During dynamic impact of the club head 10 with a golf ball, the backstop 152 contacts the face panel rear surface 76 to prevent over flexing of the face panel 72. The flex-controlling surface 162 may not be in contact with the face panel 72 when the golf club 10 is at rest. In other words, the backstop 152 does not contact the rear surface 76 of the face panel 72 in a first configuration (i.e. at rest state). The backstop 152 contacts the rear surface 76 of the face panel 72 in a second configuration (i.e. deformed state). The backstop 152 prevents over flexing of the face panel 72 during the golf ball impact.

The enclosed portion 174, which partially fills the interior cavity 124, can comprise the backstop 152 and the flex-controlling surface 162. As described below, the backstop 152 is centrally located, generally behind a geometric center of the strike face 26. The flex-controlling surface 162 is peripherally located, the majority of it being generally behind upper toe and upper heel regions of the strike face 26. Both the backstop 152 and the flex-controlling surface 162 can be closer to the face panel 72 than the remainder of the insert enclosed portion 174. In other words, the backstop gap distance 66 and flex-controlling gap distance are less than the insert gap distance 64. The backstop gap distance 66 and the flex-controlling gap distance allow the face panel 72 to bend without over-flexing (i.e. the backstop 152 and/or flexing controlling surface 162 temporarily contacts the face panel 72 during the golf ball impact).

The enclosed portion 174 can comprise the offset surface 144 of the insert 140. The offset surface 144 can further comprise the backstop 152 and the flex-controlling surface 162, described above. In other words, the backstop 152 and the flex-controlling surface 162 are both disposed on a front of the enclosed portion 174. As described above, the insert gap distance 64, the backstop gap distance 66, and the flex-controlling gap distance work together to control face panel bending.

Referring to FIG. 12, the backstop 152 of the insert 140 can be centrally located behind the strike face 26. Compared to the remainder of the insert offset surface 144, the backstop 152 can be closer to the face panel 72. In other words, the backstop 152 can be offset inwards from the rear surface 76 of the face panel 72 by less distance than the remainder of the insert offset surface 144. The backstop 152 can be offset from the rear surface 76 of the face panel 72 by a backstop gap distance 66 that is less than the insert gap distance 64.

Referring to FIGS. 12, the backstop gap distance 66 can range between 0.015 inch and 0.065 inch. In some embodiments, the backstop gap distance 66 can range between 0.015 inch to 0.040 inch, or 0.040 inch to 0.065 inch. In other embodiments, the backstop gap distance 66 can range between 0.015 inch to 0.035 inch, 0.025 inch to 0.045 inch, 0.035 inch to 0.055 inch, or 0.045 inch to 0.065 inch. For example, the backstop gap distance 66 can be 0.015, 0.020, 0.025, 0.030, 0.035, 0.040, 0.045, 0.050, 0.055, 0.060, or 0.065 inch. In one example, the backstop gap distance 66 can be approximately 0.025 inch. In another example, the backstop gap distance 66 can be 0.05 inch. The backstop gap distance 66 controls how much the backstop 152 caps or limits face flexing.

The backstop 152 can prevent the face panel 72 from over flexing by limiting the distance the face panel 72 can bend before encountering resistance from the insert 140. The gap between the insert 140 and the face panel 72 promotes face flexing, without allowing over-flexing that could result in structural failure. The insert gap distance 64 and the backstop gap distance 66 are critical to this balance between face flexibility (tied to ball speed) and durability.

The backstop 152 can be located behind the geometric center 50 of the strike face 26. The geometric center reference axis 52 can intersect the backstop 152. The backstop 152 protrudes from the remainder of the insert offset surface 144. The backstop 152 can comprise a flat surface 154 that is approximately parallel to the face panel 72. The backstop flat surface 154 can have a surface area (also called the backstop surface area) that ranges between 0.05 square inch and 0.20 square inch. In some embodiments, the backstop surface area ranges between 0.05 square inch and 0.10 square inch, 0.10 square inch and 0.15 square inch, or 0.15 square inch and 0.20 square inch. In one example, the backstop surface area can be approximately 0.10 square inches.

Referring still to FIG. 9, the backstop 152 can comprise a top side 156, a toe side 158, and a heel side 160. With respect to the geometric center reference axis 52, the top side 158 can be convex, and the toe side 158 and the heel side 160, can be concave. The toe side 158 and heel side 160 can come to a rounded point at a bottom of the backstop 152. The toe side 158 and heel side 160 intersect the top side 156 to form wing shapes that point towards the toe end 12 and heel end 14, respectively. The shape of the backstop 152 can facilitate temporary limit bending of strike face 26, specifically at the points or regions where the face panel 72 is predisposed to flex more than desired. The backstop flat surface 154 can comprise a filleted connection to the backstop sides (top side, toe side, and heel side). The sides of the backstop can also comprise filleted connections to the remainder of the insert 140.

FIG. 9 illustrates the flex-controlling surface 162. Compared to the remainder of the insert offset surface 144, the flex-controlling surface 162 can be closer to the face panel 72. In other words, the flex-controlling surface 162 can be offset inwards from the rear surface 76 of the face panel 72 by less distance than the remainder of the insert offset surface 144. In some embodiments, the backstop 152 and the flex-controlling surface 162 are offset inwards by the same gap distance, but in other embodiments, they are offset by different distances. Similar to the backstop 152, the flex-controlling surface 162 can prevent the face panel 72 from over flexing by limiting the distance that the face panel 72 can bend before encountering resistance from the insert 140.

The distance of the flex-controlling surface 162 from the face panel rear surface 76 (hereafter referred to as the "flex-controlling gap distance") can range between 0 inch and 0.040 inch. In some embodiments, the flex-controlling gap distance (not illustrated) can range between 0 inch and 0.010 inch, 0.010 inch and 0.020 inch, 0.020 inch and 0.030 inch, or 0.030 inch and 0.040 inch. In some embodiments, there is no gap between the flex-controlling surface and the rear surface of the face panel (i.e. the flex-controlling gap distance is zero). The flex-controlling gap distance controls how much the flex-controlling surface caps or limits face flexing. In addition to hindering bending within regions of the face panel that are not meant to bend, the flex-controlling surface, particularly its edge, can alter the impact response of the face panel 72.

FIG. 9 illustrates the flex-controlling surface 162 of the insert 140. During impact, the flex-controlling surface 162, particularly the flex-controlling edge 164, can provide leverage to the face panel rear surface 76. This leverage alters the bending properties of the face panel 72, which can change the trajectory of the shot. For example, if a golf ball impacts higher on the strikeface 26, the flex-controlling surface 162 will contribute more dramatic leverage to the face panel 72, causing a region of the face panel 72 to angle or flatten downwards. This can provide some compensation for the undesirably high impact.

FIG. 9 illustrates the insert 140 in a heel to toe orientation (i.e. the length 142 of insert 140 is measured in a heel to toe direction). The flex-controlling surface 162 can be generally located behind an upper toe region and an upper heel region of the strike face 26, which rarely encounter direct impact from a golf ball. The flex-controlling surface 162 comprise the flex-controlling edge 164. The flex-controlling edge 164 can be concave with respect to the geometric center axis 52. The flex-controlling edge 164 arches over and above the sweet spot of the strike face 26. Above the flex-controlling edge 164, the flex-controlling surface 162 protrudes from the remainder of the insert offset surface 144. The flex-controlling surface 162 extends to top, upper toe, and upper heel sides of a region of the insert behind the face panel 72. The flex-controlling surface 162 can comprise a surface area between approximately 0.3 square inch and 0.9 square inch. For example, the flex-controlling surface 162 can comprise a surface area of 0.3, 0.4, 0.5, 0.6, 0.7, 0.8, or 0.9 square inch. In some embodiments, the flex-controlling surface 162 comprises a surface area of approximately 0.5 square inch. Considered in reverse, a region of the insert behind the face panel 72 has a sunken surface (i.e. the offset surface 144). The sunken surface corresponds to a majority of the region of the strike face 26 that encounters the most impacts, excluding the region corresponding to the central backstop 152. The sunken surface can comprise an area between approximately 1.5 square inches and 2.5 square inches. For example, the sunken surface can comprise an area of 1.5 square inches, 1.6 square inches, 1.7 square inches, 1.8 square inches, 1.9 square inches, 2.0 square inches, 2.1 square inches, 2.2 square inches, 2.3 square inches, 2.4 square inches, or 2.5 square inches. In some embodiments, the sunken surface can comprise an area of approximately 2 square inches, and a distance between the sunken surface and the face panel 72 can be equal to the insert gap distance 64, described above.

The shaping of the flex-controlling edge 164 determines how the face bends, which can alter the trajectory of ball flight. The flex-controlling edge 164 can comprise a straight segment 166, a deep arc segment 168, and a shallow arc segment 170. The straight segment 166 can begin in a low toe side region of the insert and extend upward and slightly inward towards, but not reaching, the top rail 18. The straight segment 166 connects to the deep arc segment 168. The deep arc segment 168 curves, concave to the geometric center reference axis 52, within an upper and toe side region of the insert 140. The deep arc segment 168 connects to the shallow arc segment 170 at approximately the midplane of the insert 140, give or take 0.5 inch to either side. The shallow arc segment 170 is also concave to the geometric center axis 52. The shallow arc segment 170 extends through an upper heel side region to an upper heel edge of the insert 140. The shallow arc segment 170 comprises an average radius of curvature that is greater than a radius of curvature of the deep arc segment 168. The deep arc average radius of curvature can range inclusively between 0.55 inch and 1 inch. The shallow arc average radius of curvature can range inclusively between 0.75 inch and 2 inches. In some embodiments, the deep and shallow arc radii of curvature are variable across the lengths of the segments.

In some embodiments, the deep arc segment 168 and the shallow arc segment 170 of the flex-controlling edge 164 can together form a single conic with a rho value of 0.5 inch and an endpoint separation of approximately 1.8 inch. A heel side endpoint of the conic can have a tangent angle, measured from a vertical reference axis, of approximately 44 degrees. A toe side endpoint of the conic can have a tangent angle, measured from a vertical reference axis, of approximately 18 degrees.

The shaping and positioning of the flex-controlling edge segments contribute to the impact response of the golf club head 10. In the illustrated embodiment of FIGS. 1-13, the flex-controlling edge 164 is not symmetric about a midplane of the insert 140, nor is it symmetric about the center reference plane 54 of the club head 10. The flex-controlling edge 164 can comprise an upper fillet at the flex-controlling surface 162 and/or a lower fillet at the junction between the edge 164 and the remainder of the insert 140.

b. Connection Between Body and Insert

The insert 140 and the body 70 can comprise alignment features, to assist in securing these components together. For example, the alignment features can comprise an interlocking channel and rail, an interlocking groove and shelf, one or more indentions and protrusions, interlocking geometry, or any other suitable aligning, interlocking, or snap-fit geometry. In some embodiments, the body 72 comprises a rail or shelf, and the insert 140 comprises a channel or groove for receiving the rail or shelf, as described below. Alternately, the body 72 can comprise the channel or groove, and the insert 140 can comprise the rail or shelf. In other embodiments, the golf club head 10 can comprise another form of mechanical locking mechanism, such as pegs, snap features, and/or tabs for attaching the insert to the body. In other embodiments, the body 70 and the insert 140 can be secured together by a combination of adhesives and a mechanical connection.

Referring to FIGS. 8 and 10, the golf club head 10 comprises alignment features in the form of an insert channel 176 and a body internal rail 84. The rear portion 82 of the body 70 can comprise the internal rail 84, which extends into a portion of the interior cavity 124. In other words, the internal rail 84 can extend away from the rear 28 and towards the front 24 of the club head 10. The internal rail 84 can also be called a cantilevered rail, cantilevered portion, a rear block, a protrusion, or track. The internal rail 84 can serve as an alignment or locking mechanism for securing the insert 140 to the body 70.

Referring to FIGS. 7 and 8, in some embodiments, the internal rail 84 can be aligned in an approximately heel-to-toe direction. The internal rail 84 can connect to and extend from the hosel transition portion 106 towards the toe end 12 and terminate before it reaches the vertical reference plane 56. The internal rail 84 is entirely within the cavity 124 and does not extend past the vertical reference plane 56. In some embodiments, the internal rail 84 does not extend past the central reference plane 54. In other words, in those embodiments, the internal rail 84 is fully on a heel side of the central reference plane 54. In some embodiments, the internal rail 84 terminates inclusively between 0 inch and 0.4 inches to the heel side of the central reference plane 54. The internal rail 84 can be configured to couple to the insert 140 or align the insert 140 within the cavity 124. The internal rail 84 can be integrally formed with the remainder of the body rear portion 82.

Referring to FIG. 8, the internal rail 84 can comprise a length 86, measured parallel to the ground plane 58 in a direction from the heel end 14 towards the toe end 12. The internal rail length 86 can range between 15% and 25% of the golf club head length 40. For example, the internal rail length 86 can be approximately 15%, 16%, 17%, 18%, 19%, 20%, 21%, 22%, 23%, 24%, or 25% of the golf club head length 40. In alternate embodiments, the internal rail length 86 can range between 25% and 60% of the golf club head length 40.

In some embodiments, the internal rail 84 can be aligned approximately parallel to the sole 20, approximately parallel to the top rail 18, or angled between the two aforementioned orientations. The internal rail 84 can comprise a front wall 88, a top wall 90, a bottom wall 92, and a toe-side wall 94. The front wall 88 can be spaced apart from the face panel 72 by a distance of at least 0.030 inch, at least 0.040 inch, at least 0.045 inch, at least 0.050 inch, at least 0.060 inch, at least 0.070 inch, at least 0.080 inch, at least 0.090 inch, or at least 0.1 inch. In some embodiments, the internal rail front surface 88 is spaced apart from the face panel 72 by a distance of approximately 0.1 inch. The spacing between the internal rail 84 and the face panel 72 allows room for the face panel 72 to bend during dynamic impact of the club head 10 with a golf ball.

Referring to FIG. 7, in some embodiments, the internal rail 84 can bound a top of an undercut void 128, which is a region of the cavity 124. The thick sole portion 144 can bound a bottom of the undercut void 128. The internal rail 84 can connect to the thick sole portion 144 behind the undercut void 128. The undercut void 128 can promote flexing of the sole 20 during impact.

Referring to FIGS. 2 and 10, which shows a rear view of the insert 140, in some embodiments, a channel 176 cuts along a back surface 146 of the insert 140 (specifically the enclosed portion 174) in a heel-to-toe direction. The channel 176 is sized to receive the internal rail 84 of the body 70. The insert channel 176 can slide over the body internal rail 84 when the insert 140 is slid into the body cavity 124. The engagement between the insert channel 176 and the body internal rail 84 helps align and secure the insert 140 in the proper position within the cavity 124. Since there can be a gap between the insert 140 and the face panel rear surface 76, the channel-rail alignment connection helps orient the insert 140 properly within the body cavity 124.

c. Weights

Figure 11:
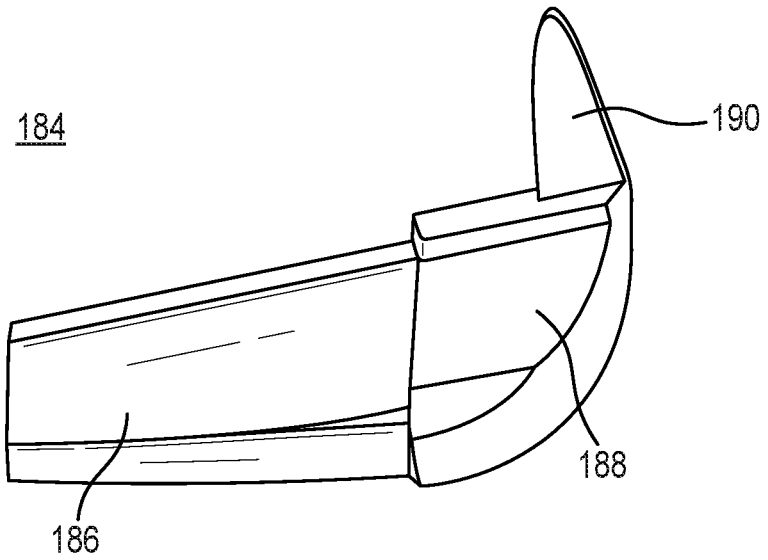
FIG. 11 shows a rear view of the internal weight of the golf club head of FIG. 1 according to an embodiment.

Referring to FIGS. 2 and 11, the golf club head 10, can comprise an internal weight 184 that is encased within the insert 140. The internal weight 184 extends into both the enclosed portion 174 and exposed portion 178. The mass distribution of the golf club head 10 can be precisely controlled by the position of the high-density internal weight 184 within the low-density insert 140. In some embodiments, the golf club head 10 can further comprise a removable toe weight and/or multiple internal weights within insert 140. A high-density internal weight 184 can be co-molded into the insert 140. FIG. 2 illustrates an exploded view having the high-density weight 184 next to the insert 140 for comparison.

Referring to FIG. 12, the internal weight 184 can be fully encased inside the insert 140. In some embodiments, the internal weight 184 can be partially located within the enclosed portion 174 and partially located within the exposed portion 178 of the insert 140. In other embodiments, the internal weight 140 is fully located within one of the enclosed portion 174 or the exposed portion 178.

Referring to FIG. 11, the internal weight 184 can have an elongate portion 186 and a bulk toe portion 188 that are integrally connected. The bulk toe portion 188 can extend closer to the top rail 18 than the elongate portion 186. The bulk toe portion 188 can comprise a peak portion 190 that extends significantly higher than the remainder of the bulk toe portion 188. The elongate portion 186 can be positioned low in the insert 140 and can extend in a roughly heel-to-toe direction. In some embodiments, the internal weight 184 can be positioned closer to the rear 28 than the front 24 of the club head 10. The internal weight 184 can be positioned closer to the toe end 12 than to the heel end 14.

Referring to FIGS. 2 and 11, in some embodiments, the golf club head 10 can further comprise an internal weight, a toe weight, a hosel tip weight located within the hosel 16 (not shown), or other weighting elements, as necessary to provide a desired mass distribution throughout the club head 10. FIGS. 2 and 11 illustrate at least one internal weight 184 that can be co-molded into the insert 140. The internal weight 184 can comprise a greater than the density of body 70 and greater than the density of the insert 140. In some embodiments, the internal weight 184 comprises a tungsten powder encased in a polymer. The internal weight 184 can be located low in the club head and closer to the toe end 12 than the heel end 14.

The internal weight 184 can comprise a tungsten material. For example, the internal weight 184 can comprise a tungsten powder encased in or infused with a polymer. The polymer can be a thermoplastic urethane (TPU), a styrene isopryne styrene (SIS) rubber, or any other suitable material. The durometer of the insert 184 can be altered by the type of polymer used. For example, a SIS polymer forms a softer internal weight than a TPU. The density of the internal weight 184 can be selected by the ratio of tungsten powder to polymer.

The internal weight 184 can have a mass that ranges between 79 g and 130 g. For example, the internal weight 184 can have a mass of approximately 110 g. The internal weight 184 can have a specific gravity ranging between 12 and 17. For example, the internal weight 184 can have a specific gravity of 14. The internal weight 184 can have a specific gravity that is greater than the specific gravity of both the body 70 and the insert 140. Because of its high specific gravity, the internal weight 184 can be used to change a center of gravity of the club head 10 by positioning the internal weight 184 in specific positions within the insert 140. In alternate embodiments, the golf club head 10 can comprise more than one internal weight (not shown).

In some embodiments, a toe weight (not illustrated) can be threaded and configured to screw into a toe cavity (also called a toe port) of the body or insert. For example, the body can comprise a threaded port that is configured to receive threaded toe weights of various densities. The toe weight can alternately be configured to receive or retain a fastener that is configured to engage the toe cavity to hold the toe weight onto the club head. The toe weight can be interchangeable (or removable). The toe weight that can be exposed at the toe end 12. In some embodiments, the toe weight can be integrally formed with the insert 140.

A hosel tip weight (not illustrated) can be placed into the hosel before a shaft is attached to the club head. The toe weight and hosel tip weight can increase the moment of inertia of the golf club head by increasing the mass in the perimeter of the club head. The combination of the hosel tip weight and the internal weight 184 provides increased perimeter weighting thereby increasing the moment of inertia of the club head 10. Increased moment of inertia provides increased forgiveness and a golfer's confidence during golf ball impacts.

The mass distribution of the club head can also be controlled and fine-tuned by injection of a damping material (not illustrated) into a portion of the cavity not filled by the insert. The damping material can be a hot melt epoxy. The damping material can be injected into the cavity via a small aperture in the face, in the toe end, in the toe cavity, or in the rear. The damping material can partially or fully fill the region of the cavity not filled by the insert.

II. Panel Insert Embodiment

Figure 15:
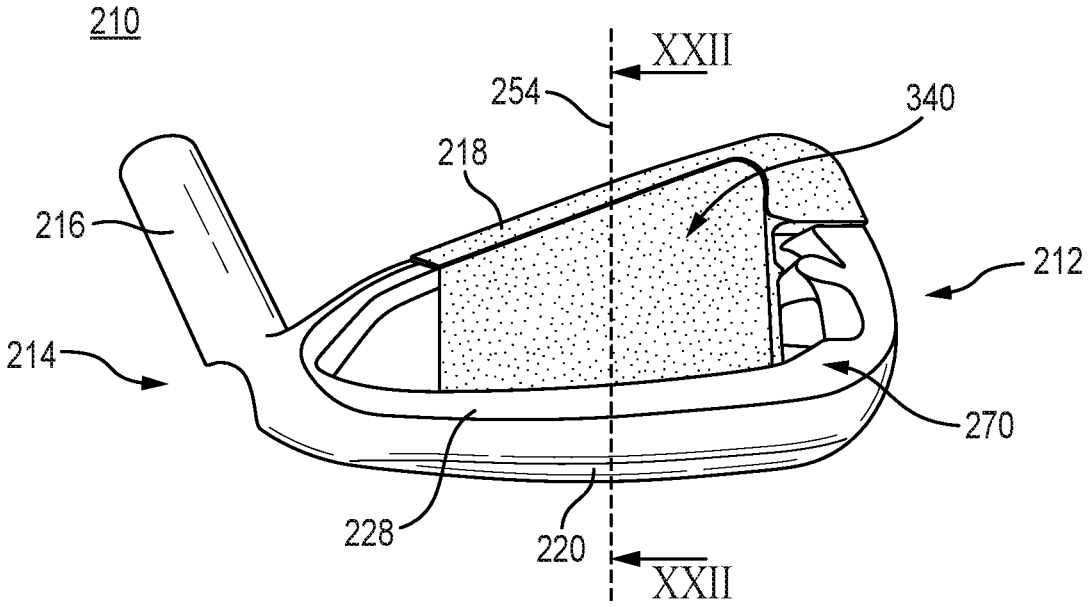
FIG. 15 shows a rear, assembled view of the golf club head of FIG. 14.
Figure 16:
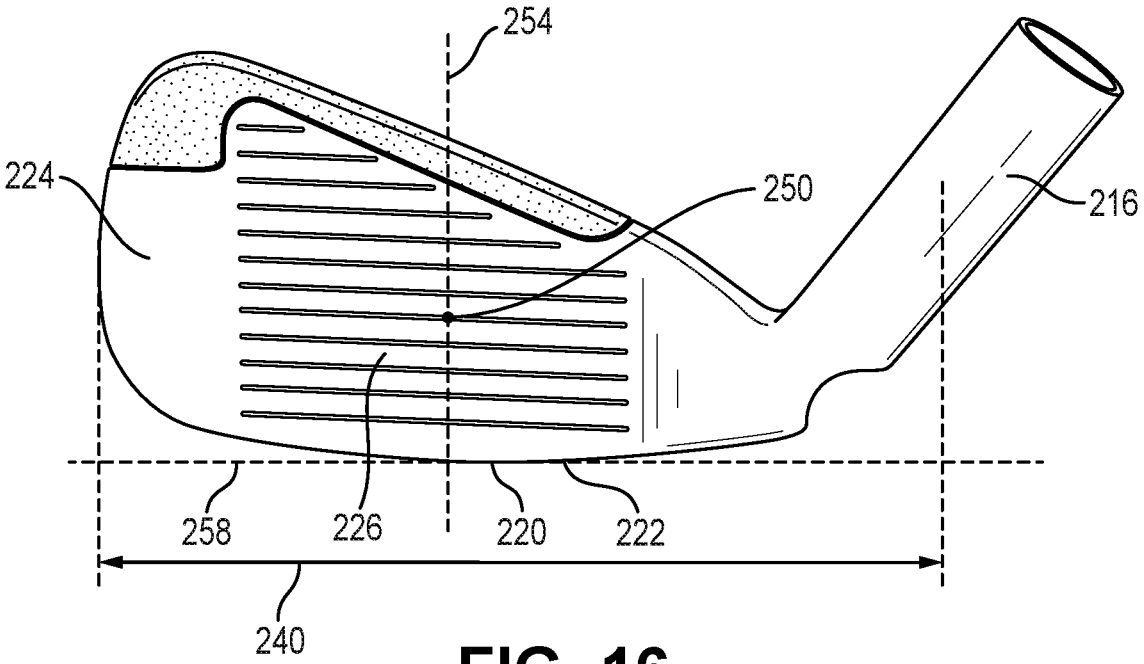
FIG. 16 shows a front, assembled view of the golf club head of FIG. 14.

FIGS. 14-22 illustrate a second embodiment of a multi-material golf club head 210 comprising a body 270 and an insert 340. The club head 210 can be a cavity back iron. In other words, the club head 210 can be a cavity back iron with a top rail insert 340. The club head 210 comprises a toe end 212, a heel end 214 opposite the toe end 212, a hosel 216 connected to the heel end 214, a top rail 218, a sole 220 opposite the top rail 218, a strike face 226, and a rear 228. The top rail insert 340 partially forms the top rail 218, the toe end 212, and/or the strike face 226. Referring to FIG. 16, the strike face 226 defines a geometric center 250. A ground plane (not shown) is tangent to the sole 220 when the club head 210 is at an address position. The club head 210 defines a loft plane (not shown) that lies tangent to the geometric center 250 of the strike face 226. The insert 340 can form a portion of a top rail 218 and extend as a panel down to the sole portion behind the strike face 226. The club head 210 can be an open-back style iron with a body 270 having a rearward sole portion and having open space across the rear between the top rail 18 and the sole portion.

Referring to FIG. 3, the club head 210 comprises a length 240, measured parallel to the ground plane in a direction from the heel end 214 towards the toe end 212. The length 240 can range from 3.0 to 4.0 inches. The length 240 can be 3.0, 3.1, 3.2, 3.3, 3.4, 3.5, 3.6, 3.7, 3.8, 3.9, or 4.0. In one example, the length 240 of the club head 210 can be approximately 3.5 inches.

The body 270 can be formed from a metal. Specifically, the body 270 can be formed from a steel alloy selected from the group consisting of: 450 steel, C250 steel, NiMark 250 steel, 475 steel, and 17-4 steel. In other embodiments, the body 270 can comprise a metallic alloy other than a steel alloy. The body 270 comprises a first density greater than a second density of the insert 340. In other words, the second density of the insert 340 is less than the first density of the body 270.

The insert 340 can be formed from a non-metal. Specifically, the insert 340 can be formed from a polymeric resin and reinforcing fibers. The insert 340 can be a polymeric composite. The polymeric resin can be a thermoplastic, such as a thermoplastic elastomer (TPE) or a thermoplastic polyurethane (TPU). The reinforcing fibers can be carbon fibers (sometimes called graphite fibers), fiberglass, aramid fibers, such as Kevlar®, or boron fibers. In other embodiments, the reinforcing fibers can be natural fibers, including but not limited to fibers from jute, flax, ramie, hemp, sugar cane, coir, sisal, grass, and abaca plants. The reinforcing fibers can be short fibers or long fibers. The reinforcing fibers can be randomly oriented within the composite. The insert 340 can be injection molded. In other embodiments, the insert 340 can also comprise a lightweight metal alloy, such as an aluminum or magnesium alloy.

i. Body

Figure 17:
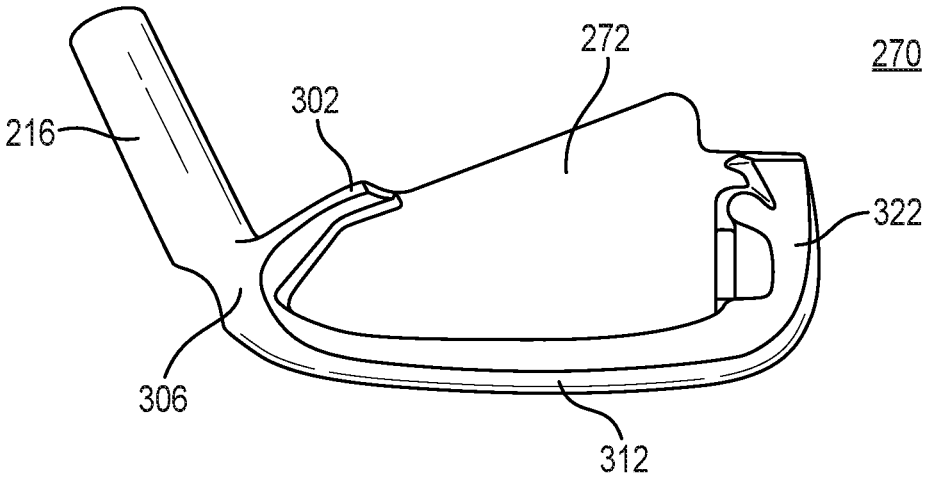
FIG. 17 shows a rear view of the body of the golf club head of FIG. 14 with the insert removed.
Figure 18:
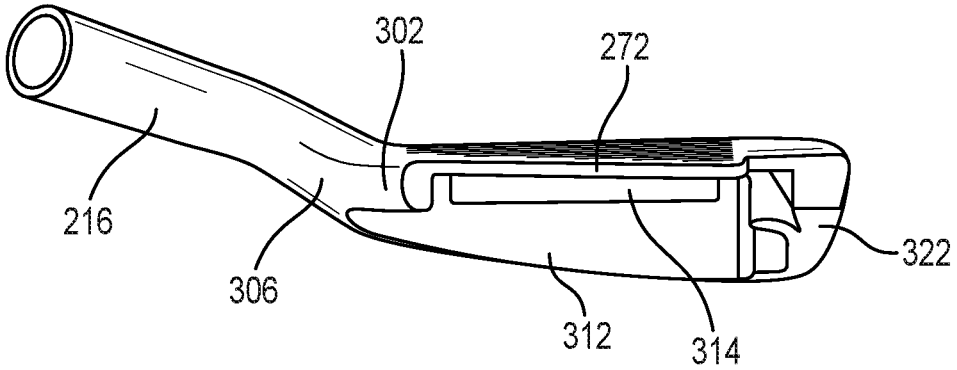
FIG. 18 shows a top view of the body of FIG. 17 with the insert removed.
Figure 19:
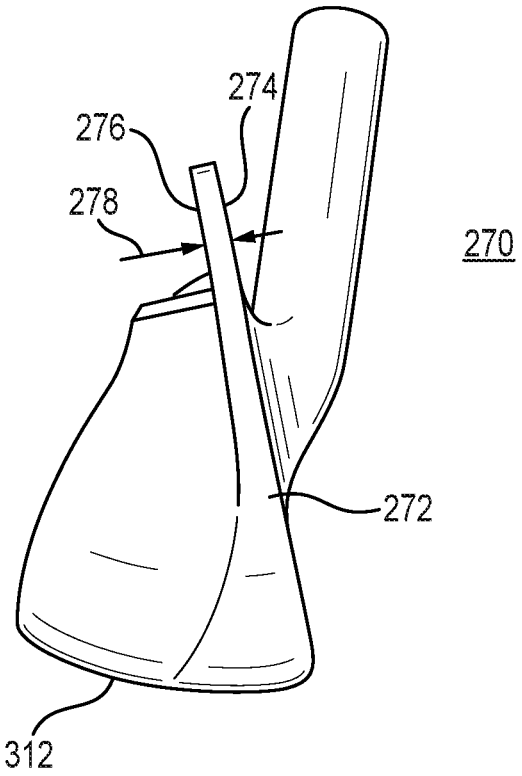
FIG. 19 shows a toe view of the body of FIG. 17 with the insert removed.

Referring to FIGS. 17-19, the body 270 is configured to receive the insert 340. The body 270 forms a majority of the club head 210. The body 270 can comprise a cylindrical hosel 16, a hosel transition portion 306, a partial top wall 302, a sole portion 312, a face panel 272, and a toe portion 322. The hosel transition portion 306 can connect the hosel 216 to the sole portion 312, the face panel 272, and the partial top wall 302. The partial top wall 302 can form a portion of the top rail 218 of the club head 210. The remainder of the top rail 218 can be formed by the insert 340, as described below. The sole portion 312 of the body 270 can connect to a bottom edge of the face panel 270. The face panel 272 can form the strike face 226 of the golf club head 210.

Referring to FIGS. 17-19, the body 270 comprises the face panel 272 having a front surface 274 and a rear surface 276. The front surface 274 of the face panel 272 can form the entirety of the strike face 226 of the club head 210. The rear surface 276 of the face panel 272 is opposite the front surface 274. FIG. 19 illustrates the face panel 272 having a thickness 278. The thickness 278 of the face panel 272 is measured between the front surface 274 and the rear surface 276. The face panel 272 can have a uniform thickness. The face panel 272 can comprise a constant thickness as measured across the strike face 226 in a heel to toe direction, and a top rail to sole direction. The face panel 272 can comprise similar or equal thickness values as thickness 78 of face panel 72 described above. In one example, the face panel thickness 278 can be approximately 0.065 inch.

FIG. 16 illustrates grooves disposed on the face panel front surface 274 for improving the grip of the golf ball against the face panel 272 during impact. The grooves can extend in a heel-to-toe direction. The face panel front surface 274 can comprise similar or equal number of grooves as described above for face panel 72.

FIG. 17 illustrates the body 270 forming a portion of the toe end 212. The toe portion 322 of the body 270 can form at least a portion of the toe end 212 of the golf club head 210. In some embodiments, the toe portion 322 of the body 270 extends from the sole 220 upwards, to form at least 40%, at least 50%, at least 60%, at least 70%, or at least 80% of a height of the toe end 212, measured orthogonally from the ground plane to an uppermost point of the toe end 212.

Referring to FIGS. 17-19, the body 270 can be substantially devoid of material directly rearward of the face panel 272. In other words, the body 270 can lack a rear component, aside from the peripheral rear surface formed by the hosel transition portion 306, the sole portion 312, and the toe portion 322. The body 270 can be configured to allow the insert 340 to be slid down onto the body 270, such that the insert 340 ends up positioned behind a portion of the body face panel 272.

Referring to FIG. 18, the sole portion 312 of the body 270 can comprise a channel 314. The channel 314 can be configured to assist with securing the insert 340. The channel 314 can extend in a heel-to-toe direction. In some embodiments, the channel 314 is angled into the sole portion 312. The channel 314 can cut closer to the rear 28 of the club head 210 as it gets deeper. This angulation of the channel 314 can assist in locking the insert 340 onto the body 270.

ii. Insert

Figure 20:
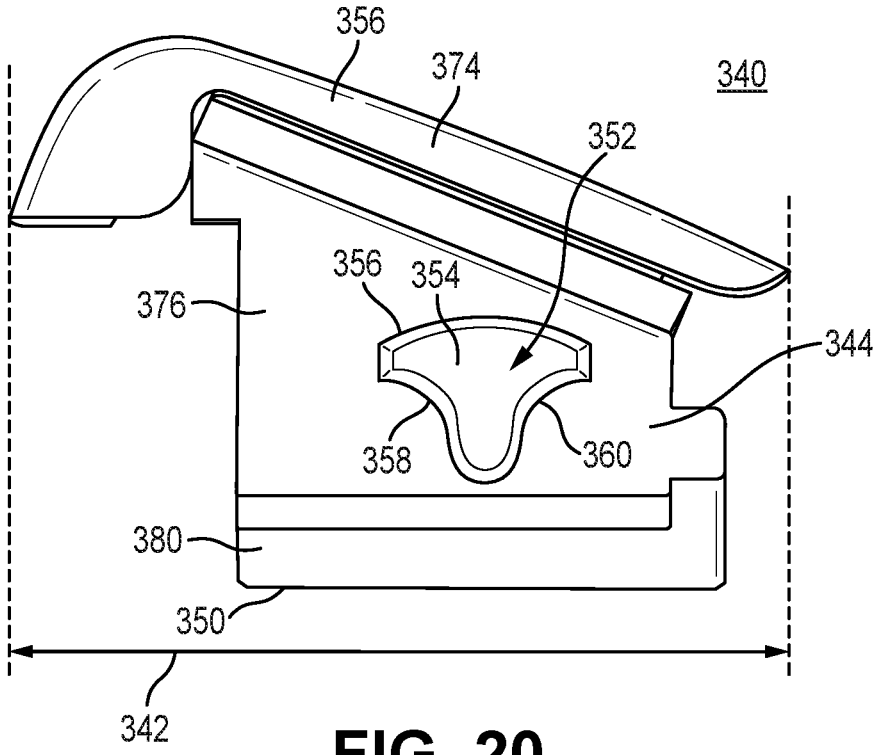
FIG. 20 shows a front view of the insert of the golf club head of FIG. 14.
Figure 21:
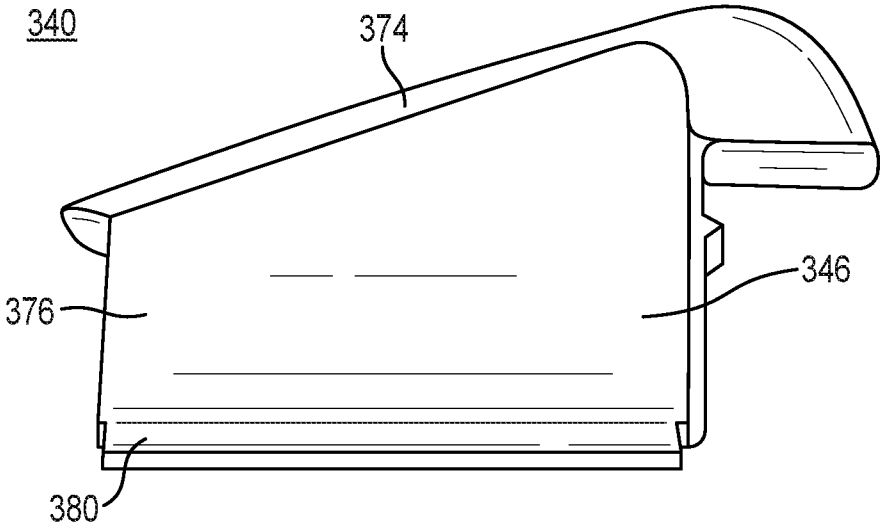
FIG. 21 shows a rear view of the insert of FIG. 20.
Figure 22:
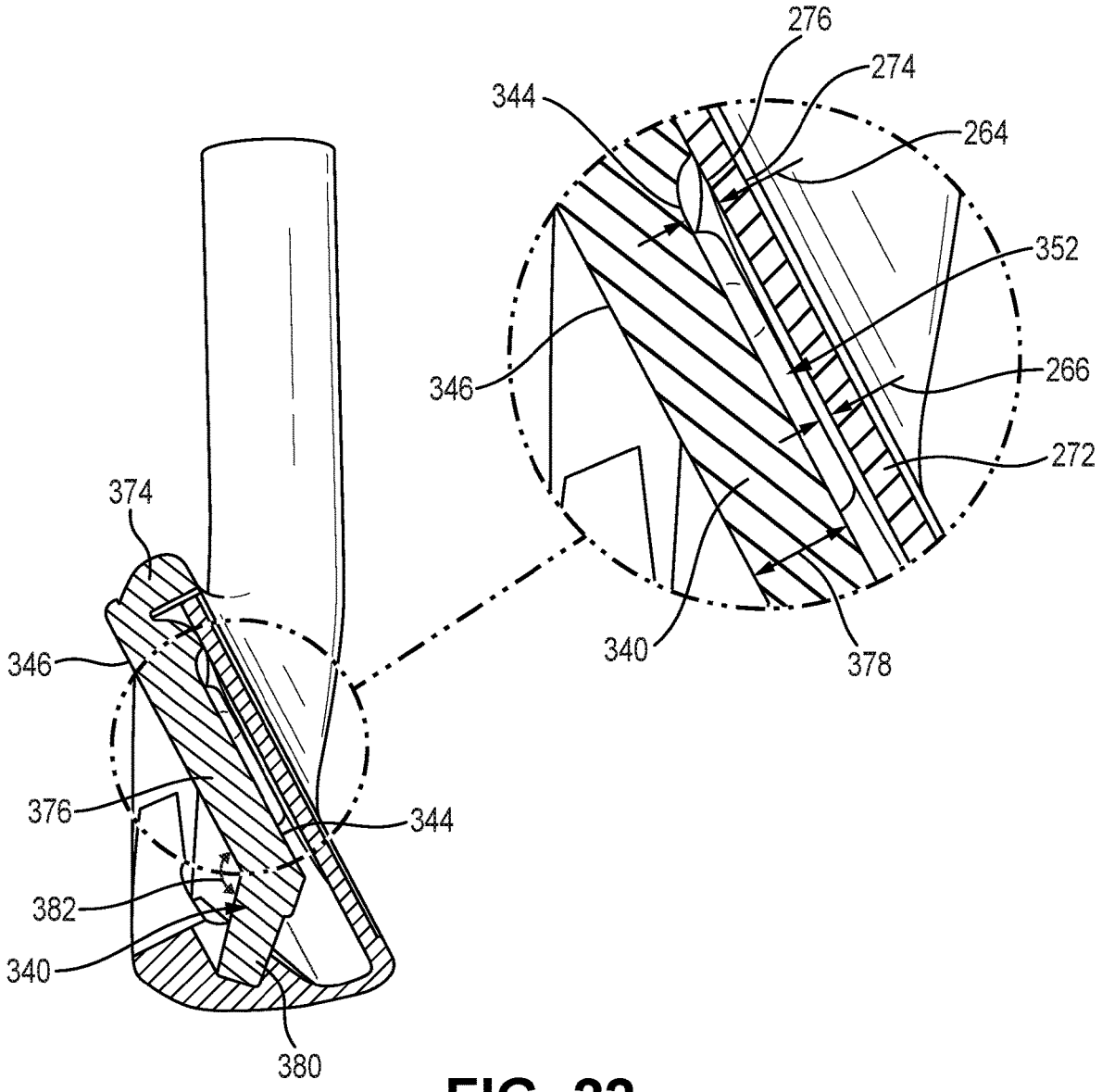
FIG. 22 shows a cross-sectional view of the golf club head of FIG. 14, taken along line XXII-XXII of FIG. 15.

Referring to FIGS. 20-22, the golf club head 210 can comprise a low-density insert 340 that can temporarily restrict deflection or movement of the face panel 272 during dynamic impact with a golf ball. The insert 340 can replace or form a portion of the club head perimeter, such as the toe end 212 and the top rail 218. The insert 340 is configured to attach, couple, and/or slide onto to the body 270.

The majority of the insert 340 can be positioned behind the face panel 272. A portion of the insert 340 forms part of the top rail 218. FIG. 20 illustrates the insert 340 comprising a rail portion 374, an insert panel 376, a backstop 352, and a shelf 380. The rail portion 374 can be configured to form a section of the top rail 218. The rail portion 374 can also form a top region of the toe end 212 of the club head 210. In the toe end 212, the rail portion 374 can sit atop the body toe portion 322, as illustrated in FIGS. 15 and 16. By extensively replacing the metal body 270 across the top rail 218 and a top region of the toe end 212, the lightweight insert 340 allows mass to be moved downwards in the club head 210. This lowers the center of gravity of the club head 210 and improves the launch characteristics of the iron.

Referring to FIG. 22, the insert 340 comprises an offset surface 344 and a back surface 346 opposite the offset surface 344. A gap is between the offset surface 344 of the insert 340 and the rear surface 276 of the face panel 272. The gap between the insert 340 and the face panel 272 can provide space for the face panel 272 to flex during the golf ball impact. FIG. 22 illustrates the gap distance 264 between the insert offset surface 344 and the face panel rear surface 276 (hereafter referred to as "insert gap distance 264") can range between 0.050 inch and 0.100 inch. In other embodiments, the insert gap distance 264 can range between 0.055 inch and 0.095 inch, 0.055 inch and 0.075 inch, 0.060 inch and 0.090 inch, 0.060 inch and 0.080 inch, or 0.065 inch and 0.075 inch. For example, the insert gap distance 264 can be 0.050, 0.055, 0.060, 0.065, 0.070, 0.075, 0.080, 0.085, 0.090, 0.095, or 0.100 inch. In one example, the insert gap distance 264 can be approximately 0.075 inch. The insert 340 does not contact the face panel 272 at a rest state (i.e. before an impact with the golf ball). In other words, the insert 340 does not lie flush against the face panel 272 during the rest state. During golf ball impacts, the face panel 272 is in a deformed state under the load of the golf ball, wherein the insert 340 contacts the rear surface 276 of the face panel 272 to prevent the face panel 272 from flexing to a point of failure.

Referring to FIG. 20, the insert can comprise a backstop 352 that protrudes from (or is disposed on) the insert offset surface 344. The backstop 352 can be configured to temporarily contact the face panel 272 when it bends during dynamic impact. When the golf club 210 is at rest, the backstop 352 does not contact the face panel 272. During dynamic impact of the club head 210 with a golf ball, the backstop 352 contacts the face panel rear surface 276 to prevent over flexing of the face panel 272. In other words, the backstop 352 does not contact the rear surface 276 of the face panel 272 in a first configuration (i.e. at rest state). The backstop 352 contacts the rear surface 276 of the face panel 272 in a second configuration (i.e. deformed state). The backstop 352 prevents over flexing of the face panel 272 during the golf ball impact.

Referring to FIG. 22, the backstop 352 of the insert 340 can be centrally located behind the strike face 226. Compared to the remainder of the insert offset surface 344, the backstop 352 can be closer to the face panel 272. In other words, the backstop 352 can be offset inwards from the rear surface 276 of the face panel 272 by less distance than the remainder of the insert offset surface 344. FIG. 22 illustrates the backstop 352 being offset from the rear surface 276 of the face panel 272 by a backstop gap distance 266 that is less than the insert gap distance 264. In other words, the insert gap distance 264 can be greater than the backstop gap distance 266.

Referring to FIG. 22, the backstop gap distance 266 can range between 0.015 inch and 0.065 inch. In some embodiments, the backstop gap distance 266 can range between 0.015 inch to 0.040 inch, or 0.040 inch to 0.065 inch. In other embodiments, the backstop gap distance 266 can range between 0.015 inch to 0.035 inch, 0.025 inch to 0.045 inch, 0.035 inch to 0.055 inch, or 0.045 inch to 0.065 inch. For example, the backstop gap distance 266 can be 0.015, 0.020, 0.025, 0.030, 0.035, 0.040, 0.045, 0.050, 0.055, 0.060, or 0.065 inch. In one example, the backstop gap distance 266 can be approximately 0.025 inch. In another example, the backstop gap distance 266 can be 0.05 inch. The backstop gap distance 266 controls how much the backstop 152 caps or limits face flexing.

The backstop 352 can prevent the face panel 272 from over flexing by limiting the distance the face panel 272 can bend before encountering resistance from the insert 340. The gap between the insert 340 and the face panel 272 promotes face flexing, without allowing over-flexing that could result in structural failure. The insert gap distance 264 and the backstop gap distance 266 are critical to this balance between face flexibility (tied to ball speed) and durability.

The backstop 352 can be located behind the geometric center 250 of the strike face 226. The backstop 352 protrudes from the remainder of the insert offset surface 344. The backstop 352 can comprise a flat surface 354 that is approximately parallel to the face panel 272. The backstop flat surface 354 can have a surface area (also called the backstop surface area) that ranges between 0.05 square inch and 0.20 square inch. In some embodiments, the backstop surface area ranges between 0.05 square inch and 0.10 square inch, 0.10 square inch and 0.15 square inch, or 0.15 square inch and 0.20 square inch. In one example, the backstop surface area can be approximately 0.10 square inches.

Referring still to FIG. 20, the backstop 352 can comprise a top side 356, a toe side 358, and a heel side 360. The backstop 352 can be similar to backstop 152 described above. With respect to the geometric center 250, the top side 356 can be convex, and the toe side 358 and the heel side 360, can be concave. The toe side 358 and heel side 360 can come to a rounded point at a bottom of the backstop 352. The toe side 358 and heel side 360 intersect the top side 356 to form wing shapes that point towards the toe end 212 and heel end 214, respectively. The shape of the backstop 352 can facilitate temporary limit bending of strike face 226, specifically at the points or regions where the face panel 272 is predisposed to flex more than desired. The backstop flat surface 354 can comprise a filleted connection to the backstop sides (top side, toe side, and heel side). The sides of the backstop can also comprise filleted connections to the remainder of the insert 340.

Referring to FIGS. 20-22, the insert 340 comprises the insert panel 376 and the rail portion 374. The insert panel 376 can be connected to a bottom of the rail portion 374 and extends behind a majority of the face panel 272 of the club head 210. The offset surface 344, back surface 346, and top edge 348 of the overall insert 340 can also correspond to (or be called) a front surface, a back surface, and a top edge of the insert panel 376, respectively. In some embodiments, the offset surface 344 can be parallel to the insert back surface 346. In some embodiments, the bottom edge 350 of the overall insert 340 can correspond to a bottom edge of the insert panel 376. FIGS. 20 and 21 illustrate the insert 340 further comprising an alignment feature 380 attached to a bottom edge of the insert panel 376, resulting in the overall insert bottom edge 350 being located on the alignment feature. For example, the alignment feature can be the shelf 380, which extends down from the insert panel 376.

Referring to FIG. 22, the insert panel 376 can have a thickness 378, measured between the offset surface 344 and the back surface 346 of the insert 340. The insert panel thickness 378 can be similar to the body face panel thickness 278. In some embodiments, the insert panel 376 can be thicker or thinner than the face panel 272. The insert 340 can further comprise the backstop 352, described above. The majority of the insert panel 376 can be located behind the face panel 272 by the insert gap distance 264, described above. The backstop 352 can be located behind the face panel 272 by the backstop gap distance 266, described above.

Referring to FIGS. 20 and 21, the golf club head 210 can comprise alignment and/or locking features along the top edge 348 and the bottom edge 350 of the insert 340. In this second embodiment, since the panel-like insert 340 is not enclosed within the body 270 (the body 270 does not have an interior cavity), the insert 340 must be secured by other means. The top edge 348 and bottom edge 350 can be epoxied to the body 270 and/or geometrically locked onto the body 270.

One means of aligning, securing, or locking the insert bottom edge 350 to the body 270 is a shelf 380 extending down from the insert panel 376. The shelf 380 can connect to a bottom edge of the insert panel 376. The shelf 380 can be integrally formed with the insert panel 376. The shelf 380 can be angled to match the angulation of the channel 314 in the sole portion 312 of the body 270. The shelf 380 can also be called a curved shelf, angled shelf, wall, securing mechanism, locking mechanism, or angled extension. The shelf 380 can be angled downwards and rearwards from the insert panel 376. The shelf 380 and the insert back surface 346 can form an angle 382 (hereafter called the "shelf angle 382") ranging inclusively between 0 and 90 degrees. In some embodiments, the shelf angle 382 can be between 0 and 25 degrees, 0 and 45 degrees, 0 and 65 degrees, 10 and 30 degrees, 20 and 40 degrees, or 30 and 60 degrees. The shelf 380 can be configured to slide, lock, or be glued into the channel 314 of the sole portion 312.

In some embodiments, the insert 340 further comprises a soft layer (not shown), positioned on the offset surface 344 of the insert 340. The soft layer can damp the impact between the face panel 272 and the insert 340. The soft layer can be an elastomer material, having a Shore A hardness that ranges inclusively between 50 and 90. In some embodiments, the soft layer has a Shore A hardness of 70. In some embodiments, the soft layer can be molded onto the insert panel 272 through a two-stage injection molding process. In other embodiments, the soft layer can be adhered or otherwise secured to the remainder of the insert 340.

Referring to FIG. 20, the insert 340 can have a length 342, measured in a direction from the heel end 214 to the toe end 212 and parallel to the ground plane 258, between 10% and 80% of the golf club head length 240. In some embodiments, the insert 340 can have a length 342 between 10% and 30%, 10% and 50%, 30% and 70%, 30% and 60%, 30% and 50%, 40% and 50%, 20% and 50%, or 50% and 80%. In some embodiments, the insert 340 has a length 342 that is approximately 50% of the golf club head length 240. The length of the insert 340 provides sufficient length to control the location of the backstop 352 behind the face panel 272.

In some embodiments, the insert 340 can have a volume ranging inclusively between 1 cubic inch and 6 cubic inches. In some embodiments, the insert volume is approximately 5 cubic inch. In some embodiments, the insert 340 can have a mass ranging inclusively between 10 g and 20 g. In some embodiments, the insert mass is approximately 15.8 g. The insert 340 can have a specific gravity that is less than the specific gravity of the body 270.

III. Advantages

The herein described golf club head 10, 210 normalize spin and ball speed across the strike face. Typical irons, lacking a thin-face and an insert with a backstop, impart high spin to a golf ball that strikes low on the face and low spin to a golf ball that strikes high on the face. The herein described golf club head embodiments normalize spin from the sole to the top rail.

The herein described golf club head 10, 210 lower the spin imparted to a golf ball that strikes low on the strike face. The thin face geometry allows greater flexing of a low portion of the strike face, reducing spin. Players on average strike the most balls on a portion of the strike face above the geometric center. The backstop 152, 352 of the insert 140, 340 can correspond to this highly used portion of the strike face. An upper portion of the backstop 152, 352 can limit the flexing of a higher portion of the face panel 72, 272. Because the backstop 152, 352 can limit face bending within the upper portion of the strike face, the upper portion of the strike face can impart greater spin to a golf ball. Therefore, the thin face coupled with the insert backstop configuration can create a more uniform spin response across the face (more uniform from the sole to the top rail).

In addition to spin performance benefits, the golf club head 10, 210 can also increase potential ball speed over existing irons lacking the thin face panel and supporting backstop, described above. The thin face panel, described above, allows the strike face to dynamically store and release impact energy to a golf ball. The face panel can bend freely until it contacts the backstop, at which point the backstop 152, 352 will damp the region of the face panel that is touching or near the backstop. The backstop 152, 352 increases durability by preventing the face panel 72, 272 from over-flexing. The backstop 152, 352 also unifies the flex response across the face, giving more consistency to shots. An off-center shot could deeply bend a region of the face panel 72, 272 that does not positionally correspond to the backstop 152, 352. In this scenario, the face panel 72, 272 would not be damped by the backstop 152, 352. Typically, the strike face of a golf club head tends to store and release the most energy at the center (hence why the center is often referred to as the "hot spot" or "sweet spot"). Thus, damping the center of the face panel results in a more uniform response, regardless of the impact location.

Furthermore, the rules of golf, as regulated by the United States Golf Association (USGA), limit the characteristic time (CT) of a strike face. Characteristic time (CT) is a measurement of face flexibility. Thin face panels can sometimes risk exceeding the CT limits set by golf regulations, because of their flexibility and responsiveness. By acting as dampers, the backstop and, optionally, the flex-controlling surface can allow for a thinner (and thus hotter, more responsive) face panel, without exceeding the flexibility limits set by golf regulations. The thin face panel, described above, increases the potential ball speed on off-center shots, compared to a golf club head with a thicker face panel.

In some embodiments, the insert 140, 340 can improve the acoustics of the club head 10, 210. For example, in some embodiments, forming the top rail at least partially with the polymeric insert can lower the amplitude generated at impact.

The club head 10, 210 comprising the insert 140, 340 improves the ball speed, ball spin, and launch conditions over a conventional club head comprising a variable face thickness (e.g. maximum center thickness that generally tapers to a minimum thickness at a periphery of the strike face). In conventional club heads comprising the variable face thickness, the difference in ball speed, ball spin, and launch conditions varies widely between center hits and off-center hits. This variance in ball performance for center and off-center hits results in inconsistent performance. The club head 10, 210 provides consistent performance (i.e. ball speed, ball spin, and launch conditions) for center and off-center hits. The club head 10, 210 brings the difference in performance for center and off-center hits closer together (i.e. reduces the large difference between center and off-center hits). The club head 10, 210 achieves desirable performance by comprising a thinned, constant thickness face panel 72, 272 and an insert 140, 340 comprising the backstop. The thinned, constant thickness face panel 72, 272 maximizes strike face deflection to maximize ball speed results. The space between the strike face and the insert 140, 340 at a rest state allows space for the strike face to flex. The backstop of the insert 140, 340 temporarily contacts the strike face during a golf ball impact to prevent the strike face from over flexing. The backstop prevents the strike face from flexing to failure or reaching a bending failure.

IV. Method of Manufacturing

The first embodiment of a golf club head 10 described herein can be manufactured by a method comprising: (1) providing a body; (2) molding an insert; (3) sliding and adhering the insert 140 into a cavity 124 of the body 70; and (4) finishing the club head 10. The body 70 can be cast or forged out of a metal material. For example, the body 70 can be formed using investment casting, gravity casting, die casting, sand casting, ceramic mold casting, plaster mold casting, expendable pattern casting, permanent mold casting, shell mold casting, or centrifugal casting. In some embodiments, a face panel 72 can be cast or forged separately and welded onto a front 24 of the club head 10 to form the body 70. Molding the insert 140 can comprise providing composite pellets, providing a mold, melting the pellets, injecting the composite material into the mold to form the insert 140, cooling the insert to harden or cure it, and ejecting the insert from the mold. More simply put, the insert 140 can be injection molded. In alternate embodiments of the method, the insert 140 can be compression molded, extrusion molded, rotationally molded, additively manufactured (such as through 3D printing), or otherwise formed into the desired shape.

Sliding and adhering the insert 140 into the cavity 124 of the body 70 can comprise applying adhesive to one or more surfaces of the body 70 and/or insert 140. The adhesive can be an epoxy, a polyurethane, a polyimide, or any other paste or liquid with adhesive properties. After the adhesive is applied, the insert 140 can be slid into the body cavity from the toe end 12 of the club head 10. The insertion of the insert 140 is complete when the insert enclosed portion 174 is fully within the cavity 124 and the insert exposed portion 178 is stopped by the body 70. Finishing the club head 10 can comprise cleaning, polishing, painting, and/or adding weights to complete the club head 10.

The second embodiment of a golf club head 210 described herein can be manufactured by a method comprising: (1) providing a body 270; (2) molding an insert 340; (3) clipping or hooking the insert 340 into a channel 314 of the body sole portion 312; (4) adhering the insert rail portion 374 to the body 270, and (5) finishing the club head 210. The body 270 can be cast or forged out of a metal material, similar to the above described method for forming the first embodiment body. Molding the insert 340 can comprise providing composite pellets, providing a mold, melting the pellets, injecting the composite material into the mold to form the insert 340, cooling the insert to harden or cure it, and ejecting the insert from the mold. More simply put, the insert 340 can be injection molded. In insert embodiments with a soft layer, the insert can be formed through a two-stage injection molding process that allows the soft layer to be over-molded onto the insert 340. In alternate embodiments of the method, the insert 340 can be compression molded, extrusion molded, rotationally molded, additively manufactured (such as through 3D printing), or otherwise formed into the desired shape.

Clipping or hooking the insert 340 onto the body can comprise placing the shelf 380 of the insert into the channel 314 of the body sole portion 312. This can require holding the insert 340 at an angle that places the rail portion 374 rearward of its final position. Once the shelf 380 is secured into the channel 314, the insert 340 can be rotated forward to align the rail portion 374 along the top rail 18 of the club head 210. Adhesive can be placed onto one or both of the body 270 and the insert 340 before the insert is attached to the body. Finishing the club head 210 can comprise cleaning, polishing, painting, and/or adding weights to complete the club head 210.

While FIGS. 1-22 depict specific embodiments of golf club heads, the disclosure of embodiments is intended to be illustrative of the scope of the present disclosure and is not intended to be limiting. It is intended that the scope of the present disclosure shall be limited only to the extent required by the appended claims. While the invention has been described in connection with various aspects, it will be understood that the invention is capable of further modifications. This application is intended to cover any variations, uses or adaptation of the invention following, in general, the principles of the invention, and including such departures from the present disclosure as come within the known and customary practice within the art to which the invention pertains.

As the rules to golf may change from time to time (e.g., new regulations may be adopted or old rules may be eliminated or modified by golf standard organizations and/or governing bodies), golf equipment related to the methods, apparatus, and/or articles of manufacture described herein may be conforming or non-conforming to the rules of golf at any particular time. Accordingly, golf equipment related to the methods, apparatus, and/or articles of manufacture described herein may be advertised, offered for sale, and/or sold as conforming or non-conforming golf equipment. The methods, apparatus, and/or articles of manufacture described herein are not limited in this regard.

Although a particular order of actions is described above, these actions may be performed in other temporal sequences. For example, two or more actions described above may be performed sequentially, concurrently, or simultaneously. Alternatively, two or more actions may be performed in reversed order. Further, one or more actions described above may not be performed at all. The apparatus, methods, and articles of manufacture described herein are not limited in this regard.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

EXAMPLES

I. Example 1: Comparison of Golf Ball Performance

An exemplary club head 10 comprising a toe end insert 140 with a gap between a strike face and a backstop will be compared to a similar control club head, but devoid of a gap between a strike face and a backstop. The test will compare the golf ball performance such as ball spin and ball speed between the exemplary club head 10 and the control club head.

The exemplary club head 10 comprises the body 70 having the face panel 72, and the insert 140 having the backstop 152. The face panel 72 comprises a constant thickness of 0.065 inch. The backstop 152 is spaced a backstop gap distance 66 away from the rear surface 76 of the face panel 72. The backstop 152 is located behind a center portion of the face panel 72. The backstop gap distance 66 is 0.025 inch at a center of the face panel 72. The insert gap distance 64 is 0.075 inch off-center. The gap provides room for the face panel to flex upon impact with a golf ball. Increased flexion in the face panel will return more energy into the golf, improving ball speed and spin.

The control club head comprises a body, a face panel, and an insert having a backstop, similar to the exemplary club head described above. The backstop of the control club head is not spaced away from the rear surface of the face panel such that the backstop abuts the rear surface of the face panel. The backstop of the control club head will limit the amount of flexion the face experiences upon impact with a golf ball, thereby reducing ball speeds and spin.

The test will be conducted using a robotic arm and/or player test. The robotic arm test will be performed by a single robot programmed to make the same swing to hit a set number of shots such that each swing will deliver the club head to the ball the same way each shot. The robotic arm test can be programed to hit the center of the strike face or any other location on the strike face so that ball speed and spin can be compared between center and off-center hits between the exemplary club head 10 and the control club head. The player test will be performed by a number of individual players. Each player will hit approximately 10 shots with each club, in increments of 5 shots. There can be approximately 20 players used for the test. A measurement device will be used to measure the various golf ball performance values such as ball spin, speed, distance, launch angle, etc.

The test will result in the exemplary club head 10 providing increased ball performance over the control club head for off-center hits. The exemplary club head 10 will be expected to have approximately 1 mph greater ball speed over the control club head for off-center hits. The exemplary club head 10 will be expected to have approximately 200 rpm greater ball spin over the control club head for off-center hits. The exemplary club head 10 comprises the thin, constant thickness face panel 72, and the insert 140 with the backstop 152 spaced away from the strike face by the backstop distance 66. The exemplary club head 10 will provide greater ball speed and ball spin results because the thinned, strike face will flex without hinderance. The backstop 152 will temporarily engage with the strike face to prevent over flexing of the strike face and strike face failure. The control club head with the backstop contacting the strike face during the golf ball impact will provide less flexion thereby less ball spin and speed.

Clause 1. A golf club head comprising: a body comprising a face panel, a toe end, a heel end, a top rail, a sole, and a rear portion; an insert comprising an enclosed portion and an exposed portion; wherein: the body defines an interior cavity that is bounded by the face panel, the heel end, the top rail, the sole, and the rear portion; the body is formed from a metal and the insert is formed from a non-metal; the body defines an opening at the toe end of the golf club head; the cavity is configured to receive the insert such that the enclosed portion fits inside the interior cavity and the exposed portion forms the toe end of the golf club head; an entire outermost surface of the toe end is formed by the insert.

Clause 2. The golf club head of clause 1, wherein the insert further comprises a backstop protruding from a surface of the insert, the backstop located behind the face panel to prevent over flexing of the face panel during a golf ball impact.

Clause 3. The golf club head of clause 2, wherein the backstop of the insert does not contact a rear surface of the face panel in a first configuration, and the backstop of the insert contacts the rear surface of the panel in a second configuration.

Clause 4. The golf club head of clause 3, wherein the insert comprises an insert offset surface, the insert offset surface does not contact a rear surface of the face panel.

Clause 5. The golf club head of clause 4, wherein: an insert offset distance forms between the insert offset surface and the rear surface of the face panel; a backstop offset distance forms between the backstop and the rear surface of the face panel; and the backstop offset distance is less than the insert offset distance.

Clause 6. The golf club head of clause 1, wherein the insert comprises a thermoplastic material and a plurality of reinforcing fibers.

Clause 7. The golf club head of clause 6, wherein: the body comprises a rail located within the interior cavity and formed integrally with the sole and rear portion; and the insert comprises a channel configured to interlock and slide along the rail securing the insert to the body.

Clause 8. The golf club head of clause 1, wherein the golf club head further comprises an internal weight formed integrally with the insert, the internal weight comprising a material density greater than a material density of the body and a material density of the insert.

Clause 9. A golf club head comprising: a body comprising a face panel comprising a strike face, a toe end, a heel end, a top rail, a sole, and a rear portion; an insert comprising an enclosed portion and an exposed portion; wherein: the body defines an interior cavity that is bounded by the face panel, the heel end, the top rail, the sole, and the rear portion; the body is formed from a metal and the insert is formed from a non-metal; the body defines an opening at the toe end of the golf club head; the cavity is configured to receive the insert such that the enclosed portion fits inside the interior cavity and the exposed portion forms the toe end of the golf club head; the strike face comprises a geometric center; a center reference plane extends through the geometric center, extends perpendicular to a ground plane when the golf club head is at an address position; a vertical reference plane extends through the golf club head in a front to rear direction and perpendicular to the ground plane when the golf club head is at the address position; the vertical reference plane is offset towards the toe end from the center reference plane between 1.0 inch and 1.8 inches; the exposed portion of the insert is located completely on a toe side of the vertical reference plane; and the enclosed portion is located at least partially on a heel side of the vertical reference plane.

Clause 10. The golf club head of clause 9, wherein the insert further comprises a backstop protruding from a surface of the insert, the backstop located behind the face panel to prevent over flexing of the face panel during a golf ball impact.

Clause 11. The golf club head of clause 10, wherein the backstop of the insert does not contact a rear surface of the face panel in a first configuration, and the backstop of the insert contacts the rear surface of the panel in a second configuration.

Clause 12. The golf club head of clause 9, wherein the insert comprises a thermoplastic material and a plurality of reinforcing fibers.

Clause 13. The golf club head of clause 9, wherein: the body comprises a rail located within the interior cavity and formed integrally with the sole and rear portion; and the insert comprises a channel configured to interlock and slide along the rail securing the insert to the body.

Clause 14. The golf club head of clause 9, wherein the golf club head further comprises an internal weight formed integrally with the insert, the internal weight comprising a material density greater than a material density of the body and a material density of the insert.

Clause 15. A golf club head comprising: a body comprising a face panel, a toe end, a heel end, a top rail, a sole, and a rear portion; an insert comprising an enclosed portion and an exposed portion; wherein: the body defines an interior cavity that is bounded by the face panel, the heel end, the top rail, the sole, and the rear portion; the body is formed from a first material having a first density and the insert is formed from a second material having a second density, the second density is less than the first density; the body defines an opening at the toe end of the golf club head; the cavity is configured to receive the insert such that the enclosed portion fits inside the interior cavity and the exposed portion forms an outer surface of the golf club head; the insert forms a portion of the top rail, the sole, the rear portion; and no portion of the body forms an outermost surface of the toe end.

Clause 16. The golf club head of clause 15, wherein the insert further comprises a backstop protruding from a surface of the insert, the backstop located behind the face panel to prevent over flexing of the face panel during a golf ball impact.

Clause 17. The golf club head of clause 16, wherein the backstop of the insert does not contact a rear surface of the face panel in a first configuration, and the backstop of the insert contacts the rear surface of the panel in a second configuration.

Clause 18. The golf club head of clause 15, wherein the insert comprises an insert offset surface, the insert offset surface does not contact a rear surface of the face panel.

Clause 19. The golf club head of clause 15, wherein: the body comprises a rail located within the interior cavity and formed integrally with the sole and rear portion; and the insert comprises a channel configured to interlock and slide along the rail securing the insert to the body.

Clause 20. The golf club head of clause 15, wherein the golf club head further comprises an internal weight formed integrally with the insert, the internal weight comprising a third material having a third density greater than both the first density and the second density.

Clause 21. A golf club head comprising: a toe end, a heel end opposite the toe end, a hosel connected to the heel end, a top rail, a sole opposite the top rail, a leading edge at a front of the sole, a front, and a rear, a body comprising: a cylindrical hosel, a hosel transition portion, adjacent the heel end, a face panel, a toe portion, adjacent the toe end; a sole portion, adjacent the sole; an insert comprising: an offset surface, a back surface opposite the offset surface, a top edge, and a bottom edge opposite the top edge; a rail portion; an insert panel; a backstop; a securing mechanism; wherein: the insert is configured to fit onto the body, such that the rail portion of the insert forms a portion of the top rail; the face panel has a face panel thickness that is less than 0.060 inch; a density of the insert is lower than a density of the body; the insert offset surface and the face panel define an insert gap distance, ranging inclusively between 0.055 inch and 0.075 inch; and the backstop and the face panel define a backstop gap distance, ranging inclusively between 0.015 inch and 0.040 inch.

Clause 22. The golf club head of clause 21, wherein: the securing mechanism comprises a shelf extending from the insert panel; the sole portion of the body defines a channel configured to receive the shelf; and the shelf has a shape that is complementary to the channel of the sole portion.

Clause 23. The golf club head of clause 21, wherein: the shelf extends rearwards from the insert panel; the shelf and the insert back surface form an angle ranging from 0 to 45 degrees.

Clause 24. The golf club head of clause 21, wherein: the insert comprises a resin and reinforcing fibers; the resin is a material selected from the group consisting of: a thermoplastic elastomer (TPE) and a thermoplastic polyurethane (TPU); and the reinforcing fibers are a material selected from the group consisting of: carbon fibers, fiberglass, aramid fibers, boron fibers, jute fibers, flax fibers, ramie fibers, hemp fibers, sugar cane fibers, coir fibers, sisal fibers, grass fibers, and abaca plant fibers.

Clause 25. The golf club head of clause 21, wherein: the insert comprises a metal material selected from the group consisting of: an aluminum alloy and a magnesium alloy.

Clause 26. The golf club head of clause 21, wherein: the insert further comprises a soft layer attached to the offset surface of the insert panel; and the soft layer comprises an elastomer material.

Clause 27. The golf club head of clause 21, wherein: the toe portion of the body extends from the sole upwards to form at least 50% of the toe end of the club head.

Clause 28. The golf club head of clause 21, wherein: the body comprises a cast steel alloy selected from the group consisting of: 450 steel, C250 steel, NiMark 250 steel, 475 steel, and 17-4 steel.

Clause 29. The golf club head of claim 21, wherein: the toe end of the body forms a toe port; the golf club head further comprises a toe weight that fits within the toe port; and the golf club head further comprises a tip weight that fits within the hosel.

Clause 30. The golf club head of claim 1, wherein: a length of the insert, measured in a direction from the heel end to the toe end, is between 30% and 60% of a total length of the golf club head.

Various features and advantages of the disclosure are set forth in the following claims.

The invention claimed is:

1. A golf club head comprising:

a toe end, a heel end, a top rail, a sole, a strike face, and a rear portion;

a body comprising a face panel;

an insert comprising an enclosed portion and an exposed portion;

wherein:

the body defines an interior cavity that is bounded by the face panel, the heel end, the top rail, the sole, and the rear portion;

the body is formed from a metal and the insert is formed from a non-metal;

the body defines an opening at the toe end of the golf club head;

the interior cavity is configured to receive the insert such that the enclosed portion fits inside the interior cavity and the exposed portion forms the toe end of the golf club head; and an entire outermost surface of the toe end is formed entirely by the insert;

wherein the insert further comprises a backstop protruding from a surface of the insert;

wherein the backstop comprises a shape comprising a top side, a toe side, and a heel side;

wherein the top side is convex and the toe side and the heel side are concave with respect to a geometric center reference axis;

the toe side and the heel side come to a rounded point at a bottom of the backstop;

the toe side and the heel side intersect the top side to form a pair of wing shapes that point towards the toe end and the heel end; and wherein the shape facilitates temporary limit bending of the strike face at a region where the face panel is predisposed to flex more than desired, and the backstop located behind the face panel prevents over flexing of the face panel during a golf ball impact.

2. The golf club head of claim 1, wherein the backstop of the insert does not contact a rear surface of the face panel in a first configuration, and the backstop of the insert contacts the rear surface of the panel in a second configuration.

3. The golf club head of claim 2, wherein the insert comprises an insert offset surface, the insert offset surface does not contact a rear surface of the face panel.

4. The golf club head of claim 3, wherein:

an insert offset distance forms between the insert offset surface and the rear surface of the face panel;

a backstop offset distance forms between the backstop and the rear surface of the face panel; and the backstop offset distance is less than the insert offset distance.

5. The golf club head of claim 1, wherein the insert further comprises a thermoplastic material and a plurality of reinforcing fibers.

6. The golf club head of claim 5, wherein:

the body further comprises a rail located within the interior cavity and formed integrally with the sole and the rear portion; and the insert further comprises a channel configured to interlock and slide along the rail securing the insert to the body.

7. The golf club head of claim 1, wherein the golf club head further comprises an internal weight formed integrally with the insert, the internal weight comprising a material density greater than a material density of the body and a material density of the insert.

8. A golf club head comprising:

a toe end, a heel end, a top rail, a sole, a strike face, and a rear portion;

a body comprising a face panel;

an insert comprising an enclosed portion and an exposed portion;

wherein:

the body defines an interior cavity that is bounded by the face panel, the heel end, the top rail, the sole, and the rear portion;

the body is formed from a metal and the insert is formed from a non-metal;

the body defines an opening at the toe end of the golf club head;

the interior cavity is configured to receive the insert such that the enclosed portion fits inside the interior cavity and the exposed portion forms the toe end of the golf club head;

the strike face comprises a geometric center;

a center reference plane extends through the geometric center, extends perpendicular to a ground plane when the golf club head is at an address position;

a vertical reference plane extends through the golf club head in a front to rear direction and perpendicular to the ground plane when the golf club head is at the address position;

the vertical reference plane is offset towards the toe end from the center reference plane between 1.0 inch and 1.8 inches;

the exposed portion of the insert is located completely on a toe side of the vertical reference plane; and the enclosed portion is located at least partially on a heel side of the vertical reference plane;

wherein the insert further comprises a backstop protruding from a surface of the insert;

wherein the backstop comprises a shape comprising a top side, a toe side, and a heel side;

wherein the top side is convex and the toe side and the heel side are concave with respect to a geometric center reference axis;

the toe side and the heel side come to a rounded point at a bottom of the backstop;

the toe side and the heel side intersect the top side to form a pair of wing shapes that point towards the toe end and the heel end; and wherein the shape facilitates temporary limit bending of the strike face at a region where the face panel is predisposed to flex more than desired, and the backstop located behind the face panel prevents over flexing of the face panel during a golf ball impact.

9. The golf club head of claim 8, wherein the backstop of the insert does not contact a rear surface of the face panel in a first configuration, and the backstop of the insert contacts the rear surface of the panel in a second configuration.

10. The golf club head of claim 8, wherein the insert further comprises a thermoplastic material and a plurality of reinforcing fibers.

11. The golf club head of claim 8, wherein:

the body further comprises a rail located within the interior cavity and formed integrally with the sole and the rear portion; and the insert further comprises a channel configured to interlock and slide along the rail securing the insert to the body.

12. The golf club head of claim 8, wherein the golf club head further comprises an internal weight formed integrally with the insert, the internal weight comprising a material density greater than a material density of the body and a material density of the insert.

13. A golf club head comprising:

a toe end, a heel end, a top rail, a sole, a strike face, and a rear portion;

a body comprising a face panel;

an insert comprising an enclosed portion and an exposed portion;

wherein:

the body defines an interior cavity that is bounded by the face panel, the heel end, the top rail, the sole, and the rear portion;

the body is formed from a first material having a first density and the insert is formed from a second material having a second density, the second density is less than the first density;

the body defines an opening at the toe end of the golf club head;

the cavity is configured to receive the insert such that the enclosed portion fits inside the interior cavity and the exposed portion forms an outer surface of the golf club head;

the insert forms a portion of the top rail, the sole, the rear portion; and no portion of the body forms an outermost surface of the toe end;

wherein the insert further comprises a backstop protruding from a surface of the insert;

wherein the backstop comprises a shape comprising a top side, a toe side, and a heel side;

wherein the top side is convex and the toe side and the heel side are concave with respect to a geometric center reference axis;

the toe side and the heel side come to a rounded point at a bottom of the backstop;

the toe side and the heel side intersect the top side to form a pair of wing shapes that point towards the toe end and the heel end; and wherein the shape facilitates temporary limit bending of the strike face at a region where the face panel is predisposed to flex more than desired, and the backstop located behind the face panel prevents over flexing of the face panel during a golf ball impact.

14. The golf club head of claim 13, wherein the backstop of the insert does not contact a rear surface of the face panel in a first configuration, and the backstop of the insert contacts the rear surface of the panel in a second configuration.

15. The golf club head of claim 13, wherein the insert comprises an insert offset surface, the insert offset surface does not contact a rear surface of the face panel.

16. The golf club head of claim 13, wherein:

the body comprises a rail located within the interior cavity and formed integrally with the sole and the rear portion; and the insert comprises a channel configured to interlock and slide along the rail securing the insert to the body.

17. The golf club head of claim 13, wherein the golf club head further comprises an internal weight formed integrally with the insert, the internal weight comprising a third material having a third density greater than both the first density and the second density.

* * * * *